US011439239B2

(12) United States Patent
Masunaga et al.

(10) Patent No.: US 11,439,239 B2
(45) Date of Patent: Sep. 13, 2022

(54) BACKREST AND CHAIR

(71) Applicant: OKAMURA CORPORATION, Yokohama (JP)

(72) Inventors: Hiroshi Masunaga, Yokohama (JP); Syunsuke Ishimaru, Yokohama (JP)

(73) Assignee: OKAMURA CORPORATION, Kanagawa-ken (JP)

( * ) Notice: Subject to any disclaimer, the term of this patent is extended or adjusted under 35 U.S.C. 154(b) by 0 days.

(21) Appl. No.: 17/285,987

(22) PCT Filed: Oct. 17, 2019

(86) PCT No.: PCT/JP2019/040924
§ 371 (c)(1),
(2) Date: Apr. 16, 2021

(87) PCT Pub. No.: WO2020/080473
PCT Pub. Date: Apr. 23, 2020

(65) Prior Publication Data

US 2021/0337971 A1 Nov. 4, 2021

(30) Foreign Application Priority Data

Oct. 19, 2018 (JP) ..... JP2018-197752

(51) Int. Cl.
*A47C 1/03* (2006.01)
*A47C 7/54* (2006.01)
*A47C 7/40* (2006.01)

(52) U.S. Cl.
CPC ..... *A47C 7/40* (2013.01); *A47C 7/541* (2018.08); *A47C 1/03* (2013.01); *A47C 1/0303* (2018.08)

(58) Field of Classification Search
CPC ..... A47C 7/541; A47C 1/03; A47C 1/0303
USPC ..... 297/411.36, 411.4, 411.41
See application file for complete search history.

(56) References Cited

U.S. PATENT DOCUMENTS 6,386,636 B2 * 5/2002 Caruso ..... A47C 1/03277 297/411.36
6,523,898 B1 * 2/2003 Ball ..... A47C 1/03 297/411.4 X
6,565,155 B1 * 5/2003 Huang ..... A47C 1/03 297/411.36 X
6,623,078 B2 * 9/2003 Chu ..... A47C 7/54 297/411.36

(Continued)

FOREIGN PATENT DOCUMENTS

JP 08-507935 8/1996
JP 2012-040109 3/2012

(Continued)

OTHER PUBLICATIONS

International Search Report for PCT/JP2019/040924, dated Dec. 3, 2019.

*Primary Examiner* — Rodney B White
(74) *Attorney, Agent, or Firm* — Nixon Peabody LLP; Jeffrey L. Costellia

(57) ABSTRACT

A backrest includes: a backrest body against which a seated person leans a back thereof, a backrest support positioned behind and supporting the backrest body; and an armrest body provided outside in a width direction of the backrest body and supported by the backrest support so as to move up and down at a position separated from the backrest body. A chair includes the above-described backrest.

6 Claims, 21 Drawing Sheets

(56) References Cited

U.S. PATENT DOCUMENTS 6,672,669 B2 * 1/2004 Chu ..... A47C 1/03 297/411.36 X
6,688,698 B1 * 2/2004 Chou ..... A47C 1/03 297/411.36
6,709,058 B1 * 3/2004 Diffrient ..... A47C 31/126 297/316
6,733,080 B2 * 5/2004 Stumpf ..... A47C 7/029 297/411.36 X
6,959,965 B2 * 11/2005 Diffrient ..... A47C 1/023 297/316
7,004,543 B2 * 2/2006 Caruso ..... A47C 1/03277 297/300.8
7,234,777 B2 * 6/2007 Schweikarth ..... A47C 7/402 297/411.36
7,475,946 B2 * 1/2009 Diffrient ..... A47C 7/38 297/411.4 X
7,857,388 B2 * 12/2010 Bedford ..... A47C 7/40 297/284.7
7,980,631 B2 * 7/2011 Diffrient ..... A47C 7/38 297/411.33 X
8,039,769 B2 * 10/2011 Asp ..... B66F 9/0759 297/411.36 X
8,590,968 B2 * 11/2013 Zahir ..... A47C 7/543 297/411.36 X
8,888,183 B2 * 11/2014 Parker ..... A47C 7/14 297/316
9,033,421 B2 * 5/2015 Wilkinson ..... A47C 7/004 297/452.64
9,155,393 B2 * 10/2015 Hurford ..... A47C 7/46
9,622,579 B2 * 4/2017 Wilkinson ..... A47C 7/14
10,130,186 B2 * 11/2018 Tong ..... A47C 7/54
10,299,595 B2 * 5/2019 Diffrient ..... A47C 3/026
10,842,281 B2 * 11/2020 Battey ..... A47C 1/032
11,109,683 B2 * 9/2021 Deevers ..... A47C 7/282
11,229,294 B2 * 1/2022 Battey ..... A47C 7/24
11,344,128 B2 * 5/2022 Chen ..... A47C 7/541
2012/0175933 A1 * 7/2012 Tsai ..... B60N 2/77 297/411.36
2014/0097658 A1 * 4/2014 Chen ..... A47C 1/03 297/411.2 X
2019/0351799 A1 * 11/2019 Kim ..... A47C 7/541
2021/0204699 A1 * 7/2021 Deevers ..... A47C 7/38
2022/0007841 A1 * 1/2022 Chen ..... A47C 7/541
2022/0175142 A1 * 6/2022 Zhou ..... A47C 1/0303

FOREIGN PATENT DOCUMENTS

JP 2017-217404 12/2017
WO WO-93-25121 12/1993

* cited by examiner

BACKREST AND CHAIR

TECHNICAL FIELD

The present invention relates to a backrest and a chair.

Priority is claimed on Japanese Patent Application No. 2018-197752, filed Oct. 19, 2018, the content of which is incorporated herein by reference.

BACKGROUND

As the backrest of a chair, a backrest is known, which includes a backrest body against which a seated person leans the back thereof, and an armrest that is provided to be next to the backrest body and on which the seated person rests an elbow thereof (refer to, for example, Patent Document 1). In such a backrest, since the armrest is supported by a frame provided at the outer periphery of the backrest body, the armrest can be provided to be close to the backrest body and can support, from a position close to the backrest, an arm of the seated person who is seated and leans the back thereof against the backrest.

DOCUMENT OF RELATED ART

Patent Document

[Patent Document 1] Published Japanese Translation No. H8-507935 of the PCT International Publication

SUMMARY

Technical Problem

In the backrest to which such an armrest is attached, when the armrest moves up and down, the armrest that is moving up and down may contact the backrest body, and the contact between the armrest and the backrest body may cause damage or deterioration of the backrest body.

Therefore, an object of the present invention is to provide a backrest and a chair that can prevent contact between an armrest (armrest body) that moves up and down and a backrest body.

Solution to Problem

A backrest of the present invention includes: a backrest body against which a seated person leans a back thereof; a backrest support positioned behind and supporting the backrest body; and an armrest body provided outside in a width direction of the backrest body and supported by the backrest support so as to move up and down at a position separated from the backrest body.

A chair of the present invention includes the above-described backrest.

In the present invention, since the armrest body is supported by the backrest support so as to move up and down at a position separated from the backrest body, when the armrest body is moved up and down, the armrest body can be prevented from contacting the backrest body.

The backrest of the present invention may include an armrest body support attached to the backrest support, the armrest body being attached to the armrest body support so as to move up and down.

According to this configuration, a lifting and lowering mechanism that lifts and lowers the armrest body is not provided in the backrest support but can be provided in the armrest body support, and thus the backrest support can have a simpler structure than a case where the backrest support is provided with the lifting and lowering mechanism.

In the backrest of the present invention, the backrest support may include a connecting part to which the armrest body support is connected in a state where the armrest body support contacts the connecting part from outside in the width direction.

According to this configuration, the armrest body support can be firmly connected to the backrest support.

In the backrest of the present invention, the armrest body support may be provided behind the backrest body, and the backrest body may include a front shielding wall, the front shielding wall being provided in front of the connecting part and the armrest body support and shielding a connection point between the connecting part and the armrest body support from front.

According to this configuration, the front shielding wall does not expose the connection point between the connecting part and the armrest body support forward, and thus the design level of the backrest can be improved.

In the backrest of the present invention, the backrest support may include a rear shielding wall, the rear shielding wall protruding outward in the width direction from a rear edge of the connecting part and shielding a connection point between the connecting part and the armrest body support from behind.

According to this configuration, the rear shielding wall does not expose the connection point between the connecting part and the armrest body support rearward, and thus the design level of the backrest can be improved.

In the backrest of the present invention, the backrest body may include an outer peripheral frame, and a surface material stretched on the outer peripheral frame and covering at least part of an outer edge of the outer peripheral frame.

According to the present invention, since the armrest body is supported by the backrest support so as to move up and down at a position separated from the backrest body, even if the surface material of the backrest body covers the outer edge of the outer peripheral frame, when the armrest body is moved up and down, the armrest body can be prevented from contacting the surface material of the backrest body.

Effects

According to the present invention, it is possible to prevent contact between the armrest body that moves up and down and the backrest body.

DESCRIPTION OF EMBODIMENTS

Hereinafter, a backrest and a chair of an embodiment of the present invention are described with reference to FIGS. 1 to 21.

Figure 1:
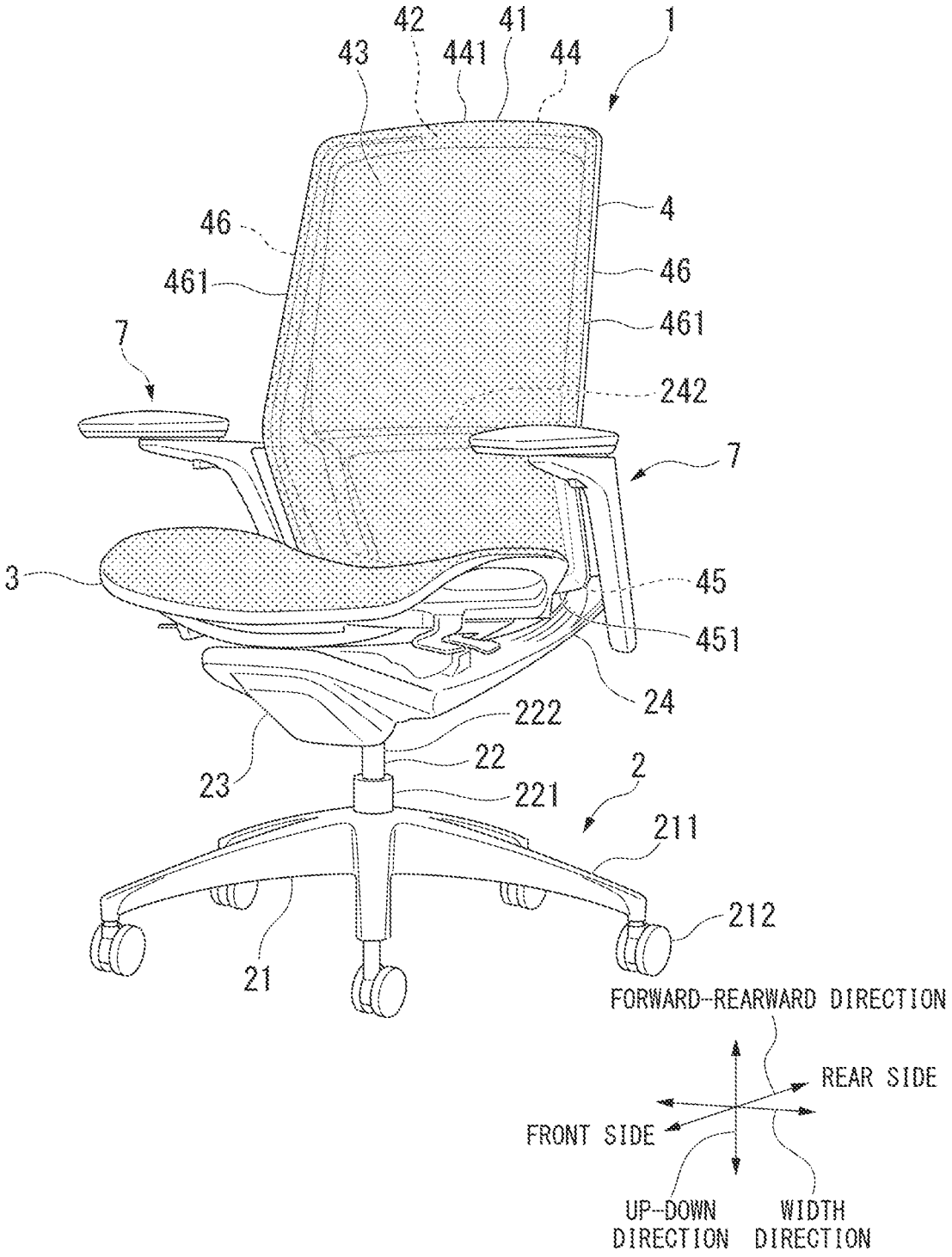
FIG. 1 is a perspective view showing an example of a chair of an embodiment of the present invention.
Figure 2:
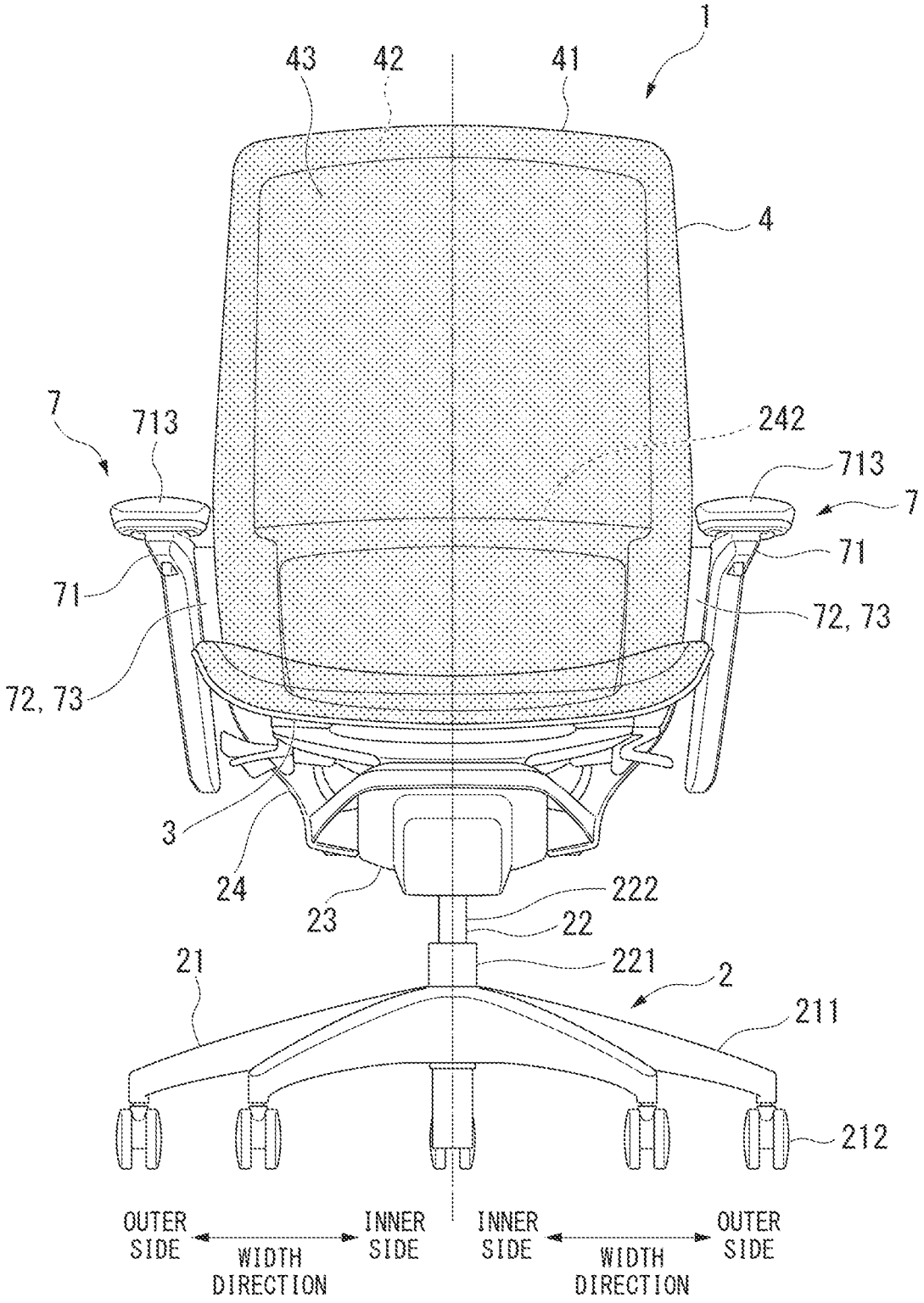
FIG. 2 is a front view of the chair of the embodiment of the present invention.
Figure 3:
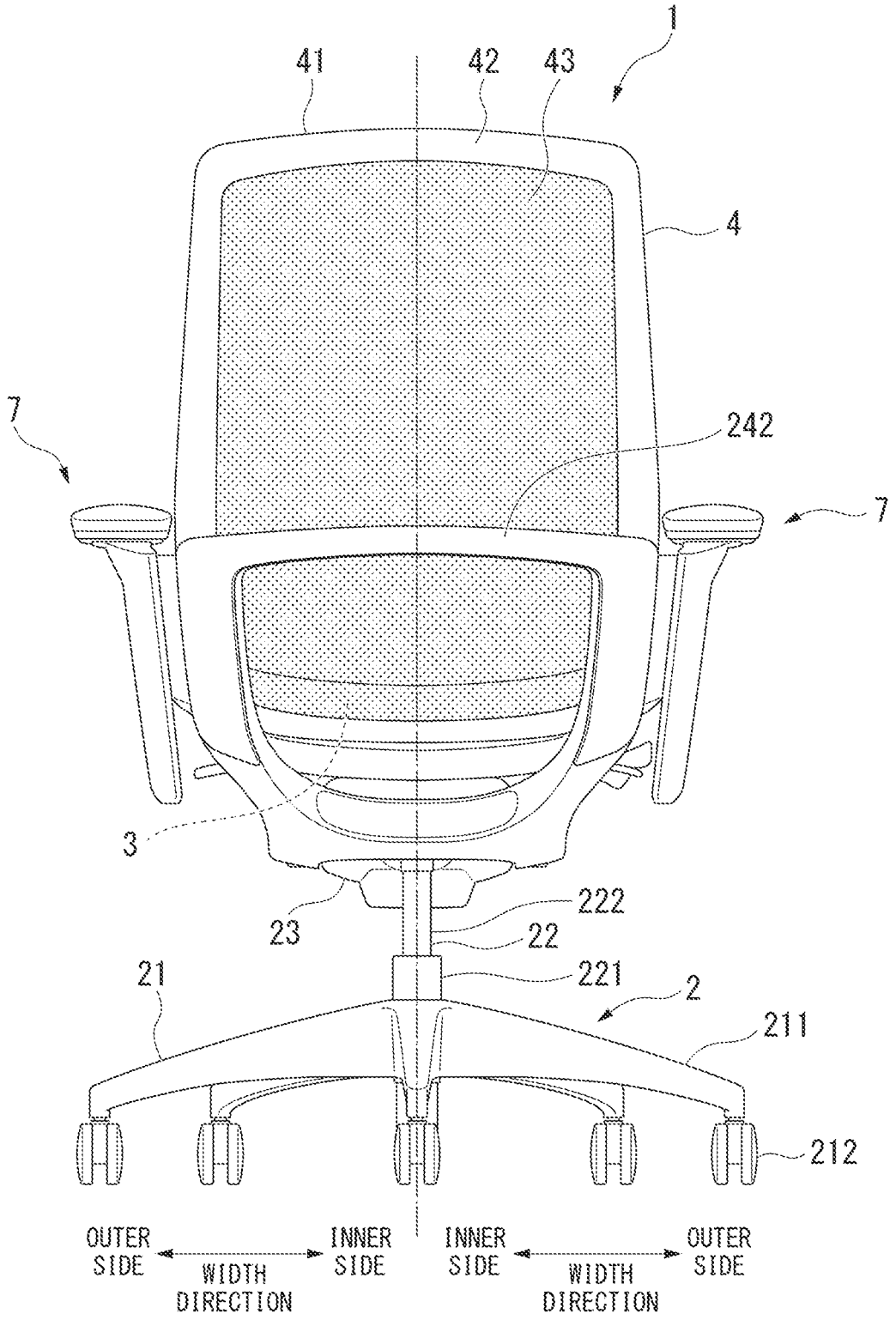
FIG. 3 is a rear view of the chair of the embodiment of the present invention.

As shown in FIGS. 1 to 3, a chair 1 of this embodiment includes a support structure 2, a seat 3, and a backrest 4.

In the following description, a side where a seated person seated in the chair 1 faces forward is referred to as a front side, the opposite side thereto is referred to as a rear side, and a horizontal direction in which the front side and the rear side are connected is referred to as a forward-rearward direction. A horizontal direction orthogonal to the forward-rearward direction is referred to as a width direction. The chair 1 has a symmetrical shape in the width direction. With regard to the width direction, both end-sides in the width direction with respect to the center in the width direction of the entire chair 1 may be referred to as "an outer side in the width direction", and the center-side in the width direction with respect to the end in the width direction of the entire chair 1 may be referred to as "an inner side in the width direction" (refer to FIGS. 2 and 3).

The support structure 2 includes a leg 21, a pedestal 22, and a support base 23.

The leg 21 includes a plurality of leg rods 211 radially arranged in plan view. The end of each leg rod 211 is provided with a caster 212, which is grounded on the floor.

The pedestal 22 is erected at the center of the leg 21. The pedestal 22 is a telescopic type with a built-in gas spring and includes an outer cylinder 221 fixed to the leg 21 and an inner cylinder 222 inserted through the outer cylinder 221 and extending above the outer cylinder 221. The inner cylinder 222 is configured to move up and down with respect to the outer cylinder 221 and to rotate relative to the outer cylinder 221.

The support base 23 is fixed to the upper end of the pedestal 22. The seat 3 is disposed on the top of the support base 23, and a backrest support 24 of the backrest 4 is disposed behind the support base 23.

The support base 23 supports the backrest support 24 such that the backrest support 24 is able to tilt (rotate) and supports the seat 3 forming a seating surface such that the seat 3 is able to tilt in conjunction with the backrest support 24.

(Backrest)

As shown in FIGS. 1 to 4, the backrest 4 includes a backrest body 41 against which the seated person leans the back thereof, the backrest support 24 positioned behind and supporting the backrest body 41, and armrests 7 that are disposed outside in the width direction of the backrest body 41 and on which the seated person rests the elbows thereof.

(Backrest Support)

Figure 4:
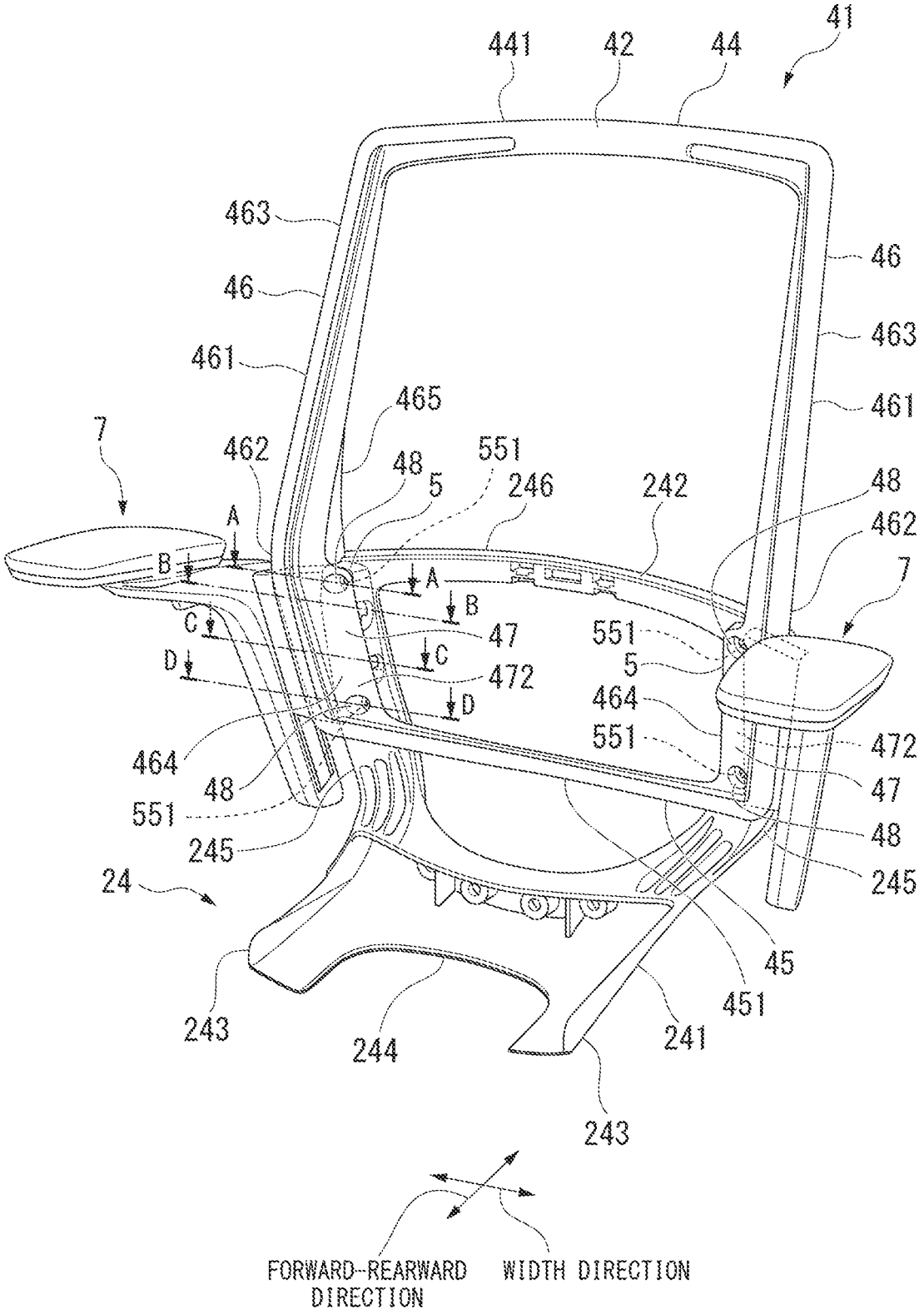
FIG. 4 is a perspective view showing a connecting structure between a backrest support and an outer peripheral frame.
Figure 5:
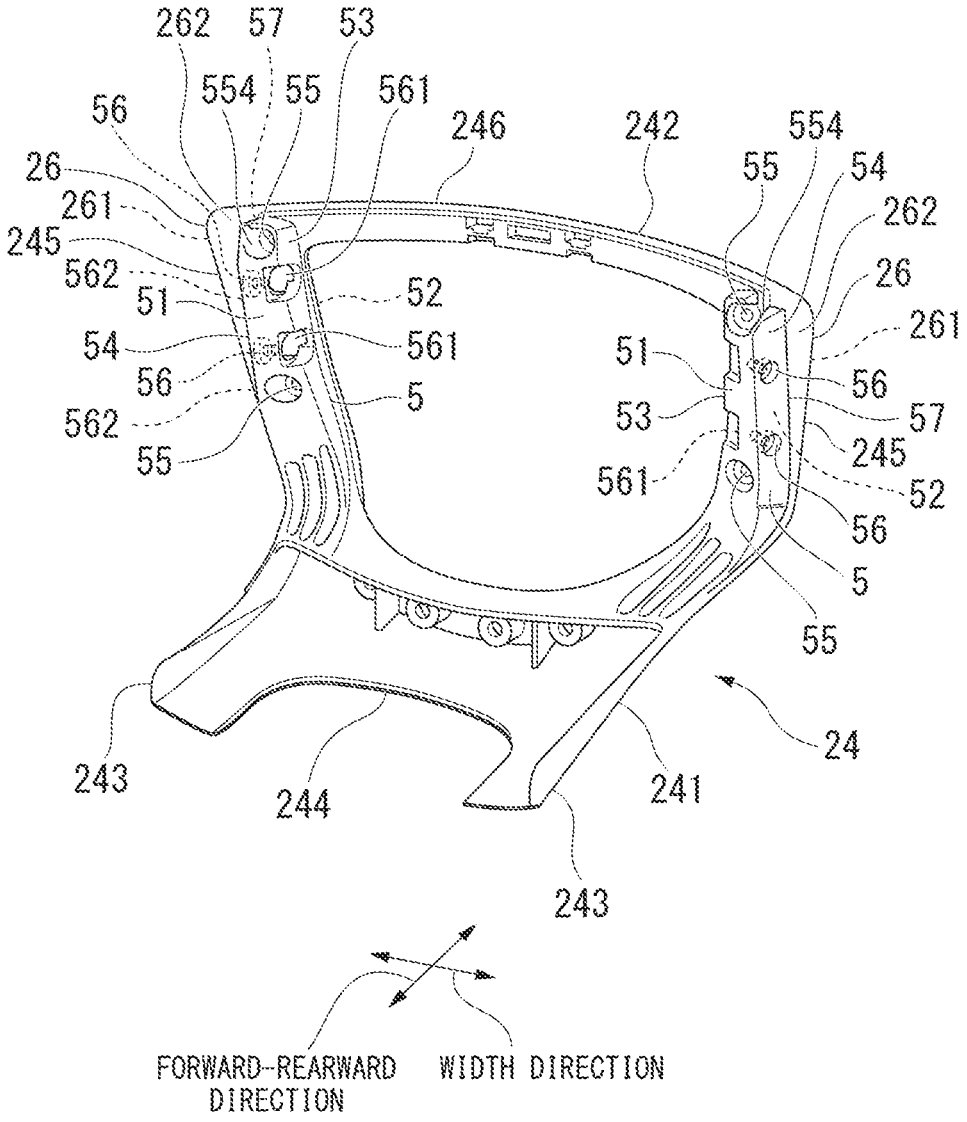
FIG. 5 is a perspective view of the backrest support.

As shown in FIGS. 4 to 5, the backrest support 24 includes a lower frame 241 connected to the support base 23 (refer to FIGS. 1 to 3) and extending further rearward than the support base 23, and a rear frame 242 extending upward from the rear end of the lower frame 241. The lower frame 241 and the rear frame 242 are integrally formed. The backrest support 24 has an L-shape in side view viewed in the width direction.

The lower frame 241 includes a pair of rear extending parts 243 extending in the forward-rearward direction and disposed at an interval in the width direction, and a lower connecting part 244 connecting intermediate parts in the forward-rearward direction of the pair of rear extending parts 243 to each other. A rear extending part 243 on one side in the width direction of the pair of rear extending parts 243 has the front end connected to one side in the width direction of the support base 23, and a rear extending part 243 on the other side in the width direction has the front end connected to the other side in the width direction of the support base 23.

The rear frame 242 includes a pair of upper extending parts 245 extending upward and forward from the rear ends of the pair of rear extending parts 243, and an upper connecting part 246 connecting the upper ends of the pair of upper extending parts 245 to each other.

The upper connecting part 246 is curved on the entire range thereof in the width direction such that the center thereof in the width direction is recessed rearward.

The pair of upper extending parts 245 are provided at an interval in the width direction. One upper extending part 245 of the pair of upper extending parts 245 is positioned to be closer to one side in the width direction than the center in the width direction of the chair 1, and the other upper extending part 245 of the pair of upper extending parts 245 is positioned to be closer to the other side in the width direction than the center in the width direction of the chair 1. Therefore, sides of the pair of upper extending parts 245 facing each other are inner sides in the width direction, and sides thereof separated from each other are outer sides in the width direction.

Each of the pair of upper extending parts 245 includes a connecting part 5 that is formed into a bar shape extending forward and upward from below and to which the backrest body 41 is fixed, and a protruding plate 26 (rear shielding wall) protruding outward in the width direction from a rear edge 57 of the connecting part 5.

As shown in FIG. 5, the connecting part 5 is appropriately provided with thickness-reduced parts having a groove shape, a recess shape, and a hole shape. The outer peripheral surface of the connecting part 5 is configured of a connecting part front surface 51 facing approximately forward, a connecting part rear surface 52 facing approximately rearward, a connecting part inner side surface 53 facing approximately inward in the width direction, and a connecting part outer side surface 54 facing approximately outward in the width direction. The expressions "surface facing a side" and "surface facing in a direction" denote surfaces whose normals extend toward the side and extending in the direction.

The connecting part rear surface 52 is formed into a surface extending forward and upward from below and extending rearward and inward from the outside in the width direction. The connecting part rear surface 52 is continuous with the rear surface of the upper connecting part 246 without through any corners or any steps.

The connecting part front surface 51 is formed into a surface extending forward and upward from below and extending rearward and inward from the outside in the width direction. The connecting part front surface 51 is almost parallel to the connecting part rear surface 52.

The rear end and the vicinity thereof of the connecting part inner side surface 53 are formed into a surface facing inward in the width direction and slightly rearward, and the part in front thereof is formed into a surface facing inward in the width direction.

The connecting part outer side surface 54 is formed into a surface extending inward in the width direction and forward from the rear. The connecting part outer side surface 54 is a surface approximately orthogonal to the connecting part rear surface 52 and the connecting part front surface 51.

The connecting part 5 has a size in the width direction gradually decreasing forward from the rear.

The connecting part 5 is provided with two first holes 55 at an interval in an up-down direction into which first bolts 61 (refer to FIGS. 6 and 7) for fixing the backrest body 41 are inserted, and two second holes 56 at an interval in the up-down direction into which second bolts 62 (refer to FIGS. 8 and 9) for fixing an armrest body support 72 of the armrest 7 are inserted.

The two second holes 56 are formed between the two first holes 55.

Figure 6:
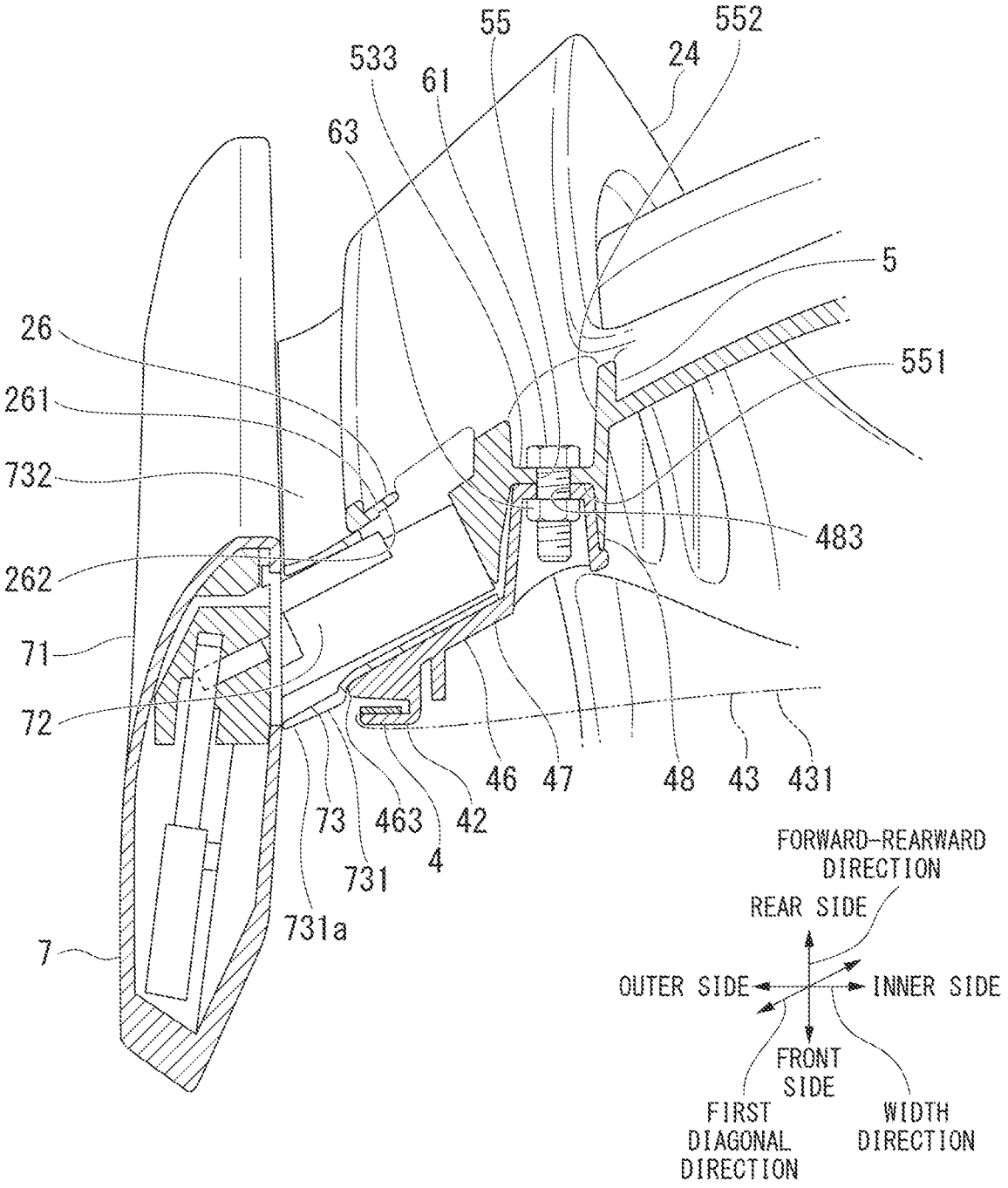
FIG. 6 is a cross-sectional view taken along line A-A in FIG. 4.
Figure 7:
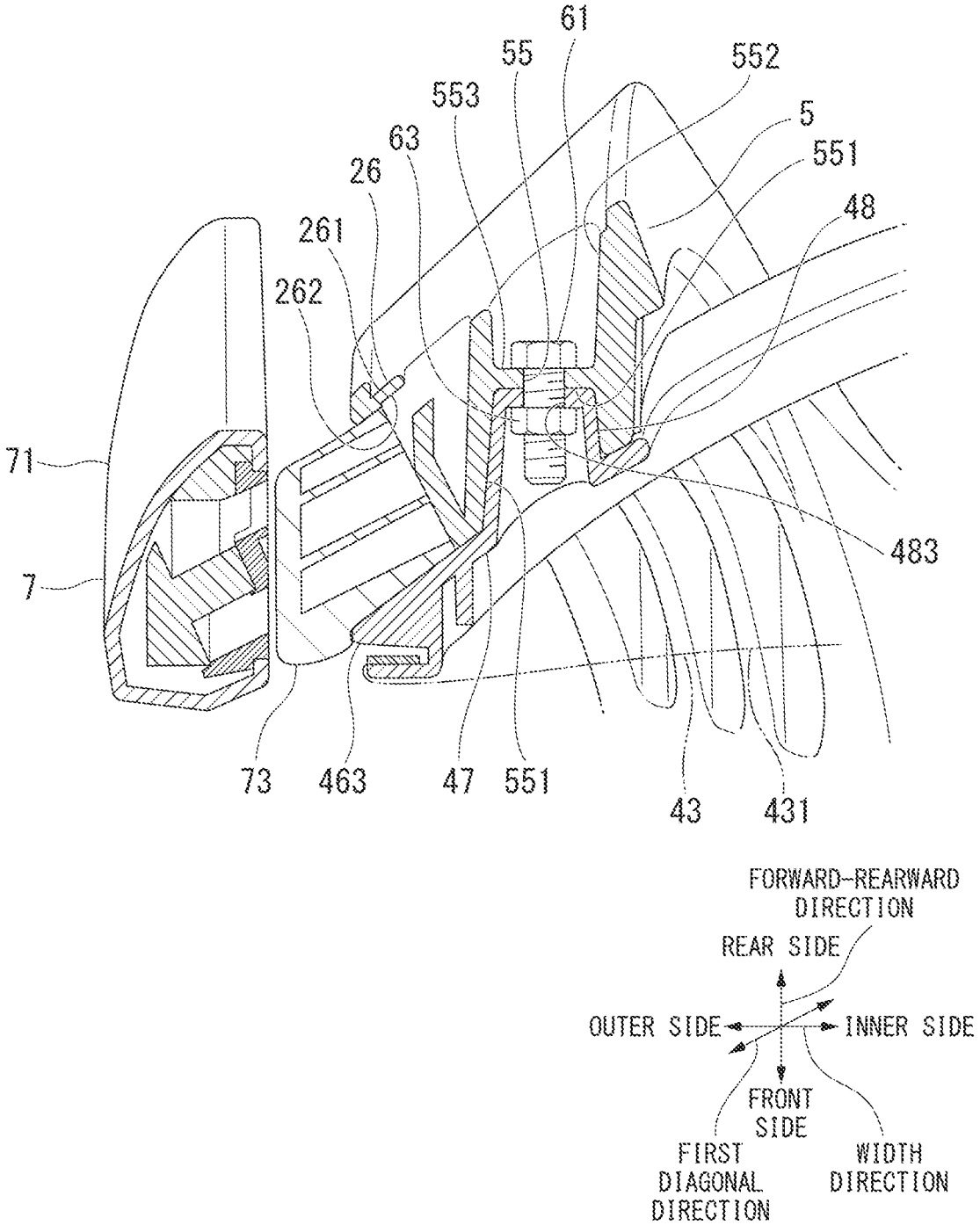
FIG. 7 is a cross-sectional view taken along line B-B in FIG. 4.

As shown in FIGS. 6 and 7, each of two parts of the connecting part 5, the two parts being at an interval in the up-down direction, is provided with a front recess 551 opening forward, and a rear recess 552 positioned behind the front recess 551 and opening rearward. The front recess 551 and the rear recess 552 are arranged in series approximately in the forward-rearward direction through an intermediate plate 553. The intermediate plate 553 is formed into a plate shape whose plate surface faces in the forward-rearward direction, and the center of the intermediate plate 553 in front view is provided with a hole penetrating therethrough in the forward-rearward direction. This hole is regarded as the first hole 55.

Returning to FIG. 5, the connecting part 5 is configured such that an upper part of one front recess 551 positioned above the other is provided with a notch 554, and the inside of the front recess 551 communicates with an area above the connecting part 5 through the notch 554. The notch 554 is positioned above an outer part in the width direction of the front recess 551.

Figure 8:
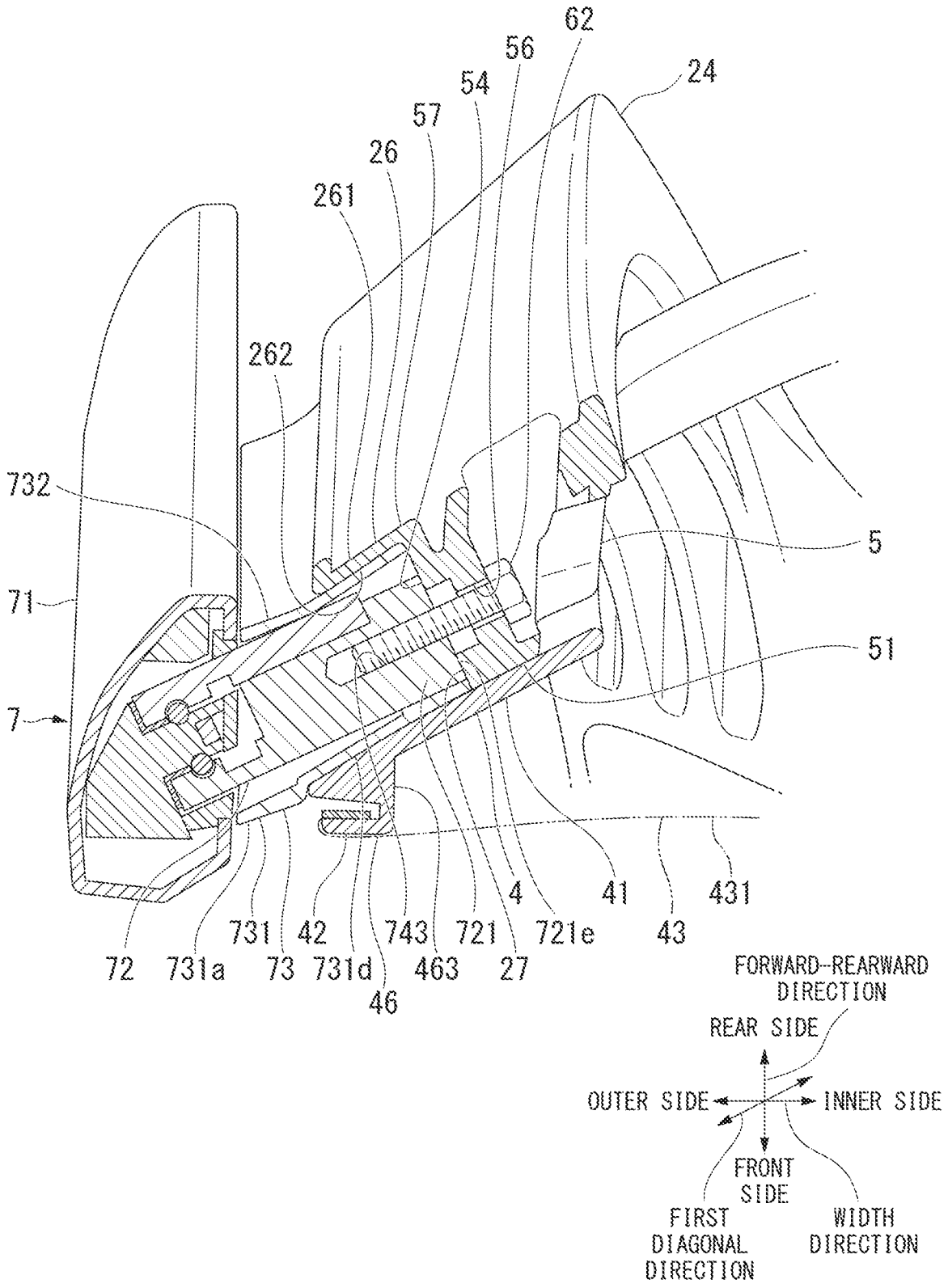
FIG. 8 is a cross-sectional view taken along line C-C in FIG. 4.
Figure 9:
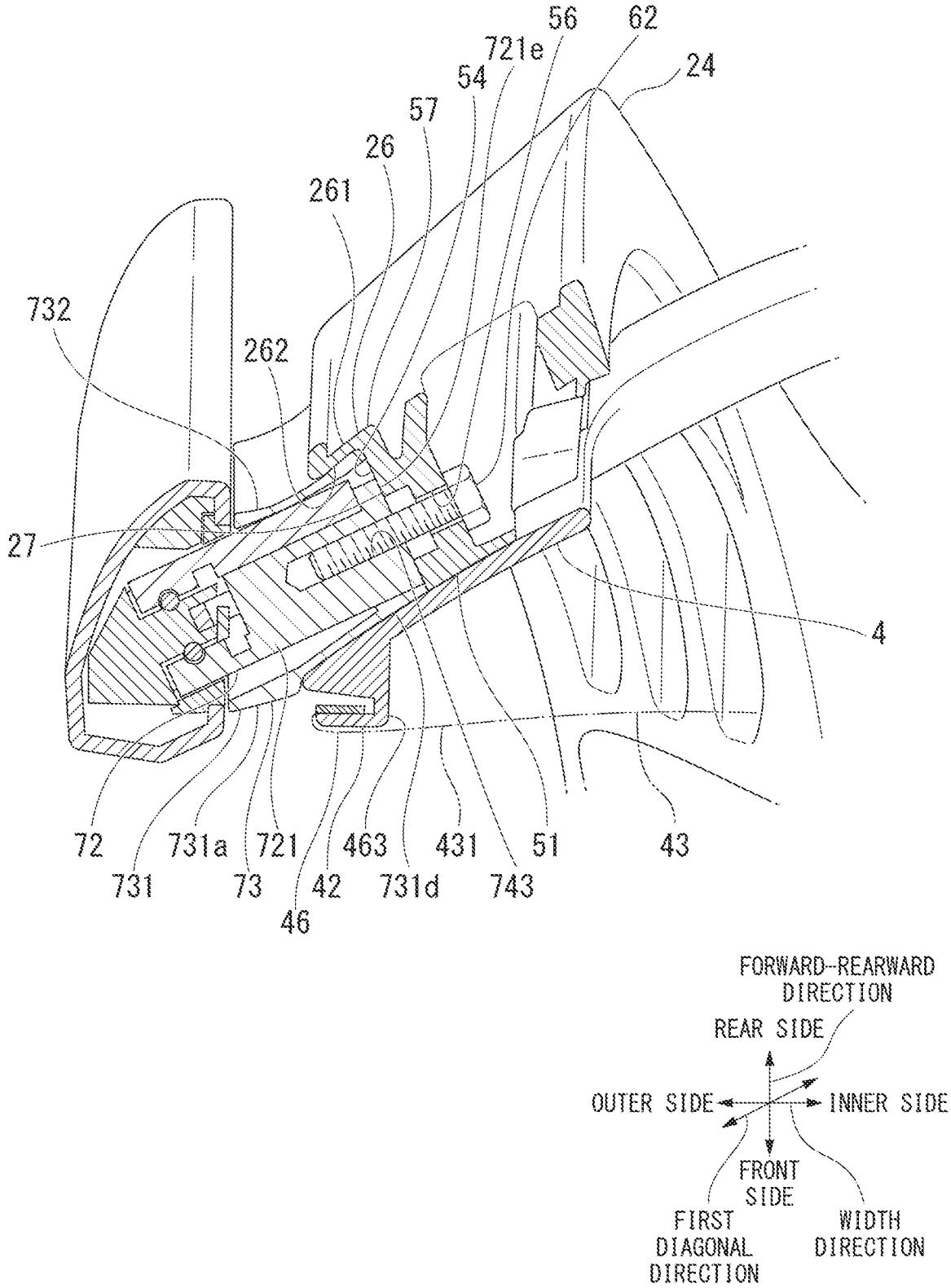
FIG. 9 is a cross-sectional view taken along line D-D in FIG. 4.

As shown in FIGS. 8 and 9, each of two parts of the connecting part 5, the two parts being at an interval in the up-down direction between the two first holes 55 (refer to FIG. 5), is provided with an inner recess 561 opening inward in the width direction. In this embodiment, the inner recess 561 also opens rearward. A bottom surface 562 of the inner recess 561 is formed into a surface extending outward in the width direction and rearward from the front. The bottom surface 562 of the inner recess 561 is disposed to be parallel to the connecting part outer side surface 54.

The connecting part 5 is provided with a hole penetrating from the bottom surface 562 of the inner recess 561 to the connecting part outer side surface 54. This hole is regarded as the second hole 56. The second hole 56 penetrates the connecting part 5 in a diagonal direction going forward and outward from the inside in the width direction. The penetration direction of the second hole 56 is a first diagonal direction, and the first diagonal direction is a direction along the connecting part front surface 51 and the connecting part rear surface 52 and goes forward and outward from the inside in the width direction.

The first diagonal direction represents one of a direction going forward and outward from the inside in the width direction, and a direction opposite thereto and going rearward and inward from the outside in the width direction. The first diagonal direction is an almost horizontal direction.

A side facing in a first direction going forward and outward from the inside in the width direction is referred to as an outer side, and a side facing in a direction opposite thereto and going rearward and inward from the outside in the width direction is referred to as an inner side.

As shown in FIGS. 5, 8 and 9, the protruding plate 26 is formed into a plate shape protruding in the first diagonal direction from the rear edge 57 of the connecting part 5, and the surface of the protruding plate 26 is along the curve of the upper connecting part 246. A rear surface 261 of the protruding plate 26 is smoothly continuous with the connecting part rear surface 52 without through any steps or a bent part 462. A front surface 262 of the protruding plate 26 is positioned behind the second hole 56. Thereby, the protruding plate 26 is configured so as not to overlap the second hole 56. The protruding plate 26 is formed into an approximately triangular shape in which the size thereof protruding outward in the width direction from the connecting part 5 decreases downward from above, and the size in the width direction of the plate surface thereof gradually decreases downward from above.

(Backrest Body)

The backrest body 41 is disposed in front of the rear frame 242 of the backrest support 24.

The backrest body 41 including an outer peripheral frame 42 having a square frame shape inside which an opening 421 is formed, and a surface material 43 covering the opening 421 and locked on the outer peripheral frame 42 (refer to FIGS. 1 to 3). In FIG. 4, the surface material 43 is omitted.

The surface material 43 is configured of a film member such as a mesh or a cloth and is formed to be larger than the front view shape of the outer peripheral frame 42 viewed from the front, and the outer edge thereof is locked on the outer peripheral frame 42.

Figure 10:
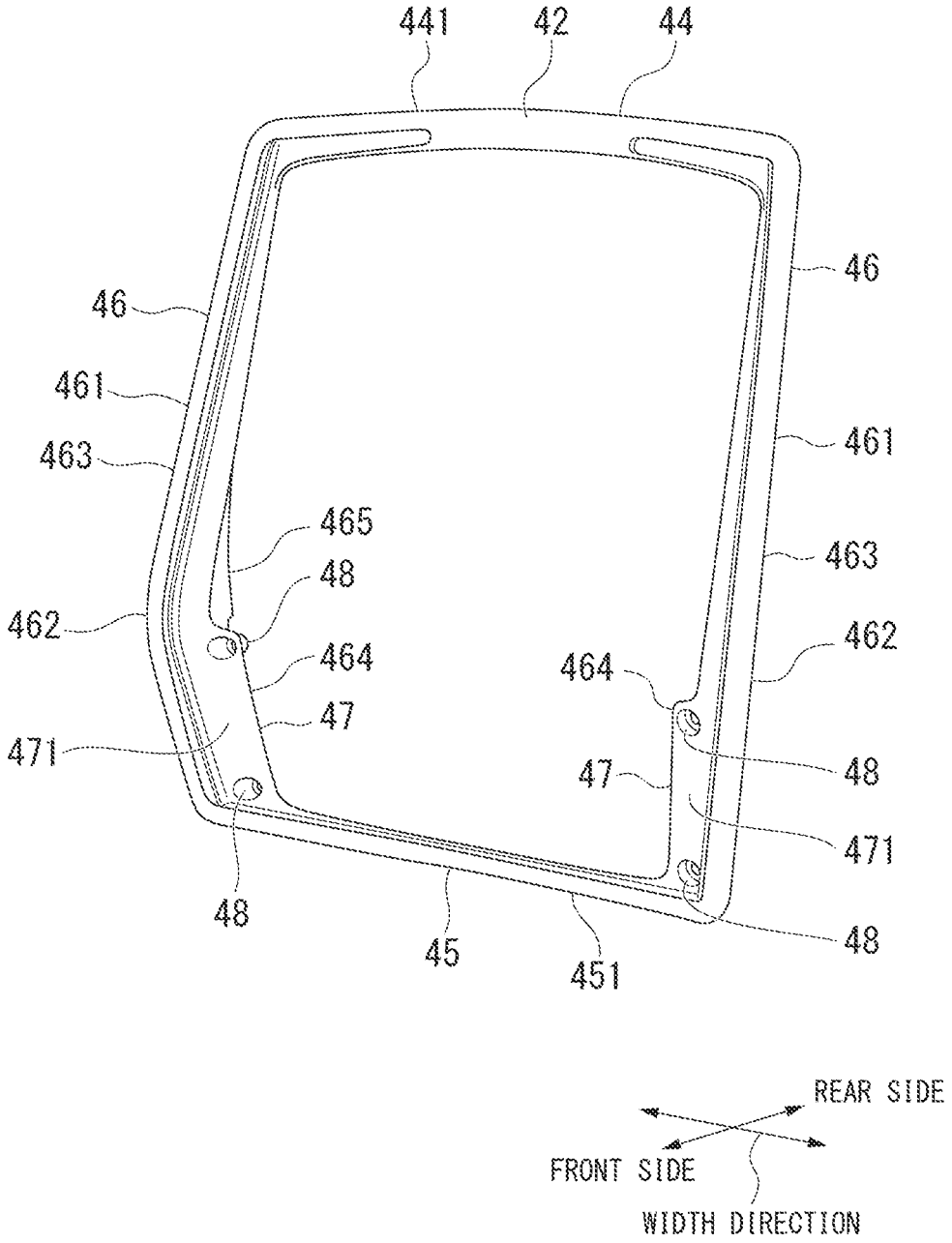
FIG. 10 is a perspective view of the outer peripheral frame viewed diagonally from front.
Figure 11:
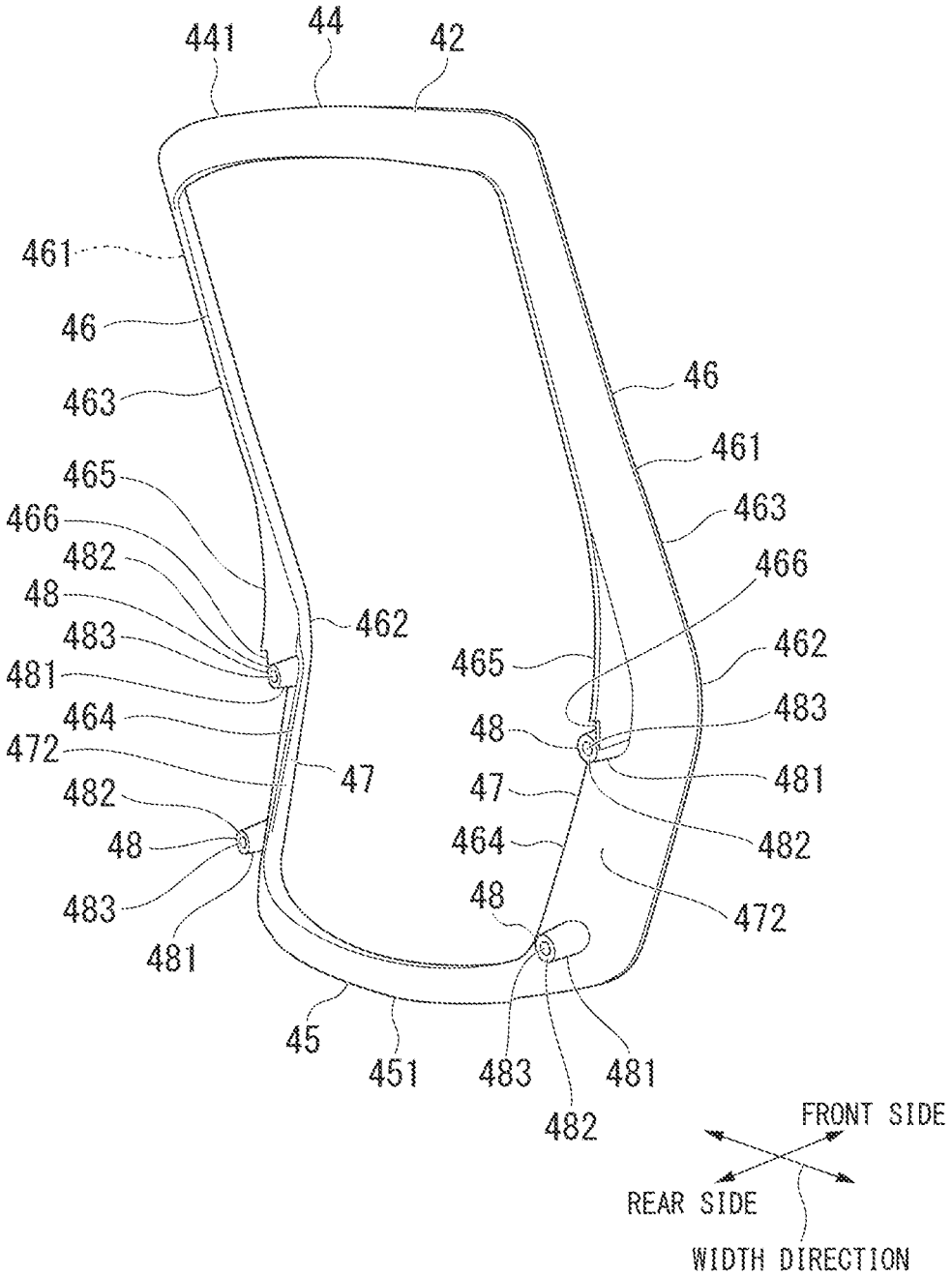
FIG. 11 is a perspective view of the outer peripheral frame viewed diagonally from behind.

As shown in FIGS. 4, 10 and 11, the outer peripheral frame 42 includes an upper frame 44, a lower frame 45, and a pair of vertical frames 46.

The pair of vertical frames 46 are provided at an interval in the width direction. One vertical frame 46 of the pair of vertical frames 46 is positioned to be closer to one side in the width direction than the center in the width direction of the chair 1, and the other vertical frame 46 is positioned to be closer to the other side in the width direction than the center in the width direction of the chair 1. Therefore, sides of the pair of vertical frames 46 facing each other are inner sides in the width direction, and sides thereof separated from each other are outer sides in the width direction.

The upper frame 44 is a member extending in the width direction and is curved on the entire range in the width direction such that the center thereof in the width direction bulges upward in front view and bulges rearward in plan view viewed from above. The upper frame 44 is provided with an upper frame surface material-locking groove 441 on which the upper edge of the surface material 43 (refer to FIGS. 1 to 3) is locked. The upper frame surface material-locking groove 441 is a groove opening upward and is formed on the entire upper frame 44 in the width direction.

The lower frame 45 is a member extending in the width direction and is curved on the entire range in the width direction such that the center thereof in the width direction bulges downward in front view and bulges rearward in plan view.

The lower frame 45 is provided with a lower frame surface material-locking groove 451 on which the lower edge of the surface material 43 is locked. The lower frame surface material-locking groove 451 is a groove opening downward and is formed on the entire lower frame 45 in the width direction.

Intermediate parts in the up-down direction of the pair of vertical frames 46 are provided with bent parts 462.

In the pair of vertical frames 46, in side view viewed in the width direction, part below the bent part 462 extends forward and upward from below, and part above the bent part 462 extends rearward and upward from below. In the pair of vertical frames 46, in front view, parts below the bent parts 462 extend outward in the width direction and upward form below, and parts above the bent parts 462 extend inward in the width direction and upward from below. The bent part 462 is positioned below the center in the up-down direction of each of the pair of vertical frames 46.

The pair of vertical frames 46 each include a surface material-locking part 463 (front shielding wall) locking the surface material 43, a backrest-connecting part 464 formed to be continuous with the surface material-locking part 463 and fixed to the backrest support 24, and a rib 465 protruding rearward from the surface material-locking part 463.

The surface material-locking part 463 is provided on the entire vertical frame 46 in the up-down direction and has the upper end connected to the upper frame 44 and the lower end connected to the lower frame 45. The surface material-locking part 463 of one of the pair of vertical frames 46 has the upper end connected to the end on one side in the width direction of the upper frame 44 and the lower end connected to the end on one side in the width direction of the lower frame 45. The surface material-locking part 463 of the other of the pair of vertical frames 46 has the upper end connected to the end on the other side in the width direction of the upper frame 44 and the lower end connected to the end on the other side in the width direction of the lower frame 45.

The surface material-locking part 463 is provided with a vertical frame surface material-locking groove 461 locking the side edge of the surface material 43. The vertical frame surface material-locking groove 461 is a groove opening inward in the width direction and is formed on the entire range in the up-down direction.

The pair of vertical frame surface material-locking grooves 461 are each continuous with the upper frame surface material-locking groove 441 and the lower frame surface material-locking groove 451. Thereby, the outer peripheral frame 42 is provided with a groove for locking the surface material 43 on the entire outer periphery.

As shown in FIGS. 10 and 11, the backrest-connecting part 464 is provided on the entire part of the vertical frame 46 below the bent part 462. The backrest-connecting part 464 is provided inward in the width direction of the surface material-locking part 463. The lower end of the backrest-connecting part 464 is connected to the lower frame 45.

The backrest-connecting part 464 includes a connecting plate 47 extending inward in the width direction and rearward from the rear edge of part of the surface material-locking part 463 below the bent part 462, and connecting protrusions 48 protruding rearward from the connecting plate 47.

The connecting plate 47 is formed into a shape elongate in the up-down direction and has the lower end connected to the lower frame 45. The connecting plate 47 has a connecting plate front surface 471 facing forward and a connecting plate rear surface 472 facing rearward, the connecting plate front surface 471 is a surface facing forward in the forward-rearward direction and slightly inward in the width direction, and the connecting plate rear surface 472 is a surface facing rearward in the forward-rearward direction and slightly outward in the width direction. The connecting plate 47 is formed into a shape along the lower frame 45 in plan view.

Two connecting protrusions 48 are provided on one connecting plate 47 at an interval in the up-down direction. As shown in FIG. 11, the connecting protrusion 48 includes a cylindrical part 481 protruding rearward from the connecting plate 47 and an end plate 482 covering and connected to the end (rear end) of the cylindrical part 481. The end plate 482 is formed into a flat plate shape whose plate surface faces in the forward-rearward direction, and the center of the plate surface is provided with a third hole 483 penetrating therethrough in the forward-rearward direction.

As shown in FIGS. 6 and 7, the connecting protrusion 48 is formed into a shape fitting into the front recess 551 of the connecting part 5 of the backrest support 24 from front. The connecting protrusion 48 is set such that the third hole 483 overlaps the first hole 55 of the front recess 551 in the forward-rearward direction when the connecting protrusion 48 is fitted into the front recess 551 of the connecting part 5 of the backrest support 24.

As shown in FIG. 11, the rib 465 is provided in an intermediate part in the up-down direction of the vertical frame 46, the intermediate part including the bent part 462 and areas above and below the bent part 462. The rib 465 is formed into a plate shape whose plate surface faces in the width direction. The lower end of the rib 465 is connected to a side surface of the cylindrical part 481 of the connecting protrusion 48 positioned above the other. The lower side of the rib 465 is a notch 466 opening rearward and downward.

As shown in FIGS. 1 and 2, the surface material 43 is stretched on the front sides of the vertical frames 46 so as to cover the inside of the outer peripheral frame 42 and wraps over the front surfaces of the upper frame 44, the lower frame 45 and the pair of vertical frames 46, and the outer edge of the surface material 43 is inserted into the surface material-locking grooves 441, 451 and 461 to be locked on the outer peripheral frame 42. A surface that is formed by the surface material 43 and against which the seated person leans the back thereof is referred to as a backrest surface 431. The backrest surface 431 is curved such that the center thereof in the width direction is further recessed rearward than the outer ends thereof in the width direction.

The surface material 43 stretched on the outer peripheral frame 42 is configured to be elastically deformable due to a load applied thereto from the front. The outer peripheral frame 42 is also configured to be elastically deformable due to a load applied to the surface material 43.

The outer peripheral frame 42 is fixed to the backrest support 24 in a state where the surface material 43 is stretched on the outer peripheral frame 42. The outer peripheral frame 42 is fixed to the front side of the rear frame 242 of the backrest support 24.

As shown in FIG. 4, the backrest-connecting parts 464 of the pair of vertical frames 46 are disposed in front of the connecting parts 5 of the upper extending parts 245 of the rear frame 242. The connecting plate 47 of the backrest-connecting part 464 has the connecting plate rear surface 472 contacting the connecting part front surface 51 of the connecting part 5. The connecting protrusion 48 of the backrest-connecting part 464 is inserted into the front recess 551 of the connecting part 5.

In a state where the third hole 483 provided in the end plate 482 of the connecting protrusion 48 of the backrest-connecting part 464 and the first hole 55 of the front recess 551 of the connecting part 5 of the backrest support 24 overlap each other in the forward-rearward direction, the first bolt 61 inserted through the third hole 483 and the first hole 55 is fastened on a nut, and thus the outer peripheral frame 42 is connected to the backrest support 24.

A lower end part of the rib 465 of each of the pair of vertical frames 46 continuous with the connecting protrusion 48 disposed above the other is inserted into the notch 554 provided in the upper side of the front recess 551 of the connecting part 5, and the part of the rib 465 above the lower end part is disposed above the connecting part 5.

In order to fix the backrest body 41 to the backrest support 24, first, the surface material 43 is attached to the outer peripheral frame 42.

The backrest-connecting parts 464 of the pair of vertical frames 46 of the outer peripheral frame 42 are disposed in front of the connecting parts 5 of the upper extending parts 245 of the rear frame 242. Then, the connecting plate rear surface 472 of the connecting plate 47 of the backrest-connecting part 464 is brought into contact with the connecting part front surface 51 of the connecting part 5. The connecting protrusion 48 of the backrest-connecting part 464 is inserted into the front recess 551 of the connecting part 5.

In this way, the third hole 483 provided in the end plate 482 of the connecting protrusion 48 of the backrest-connecting part 464 and the first hole 55 of the front recess 551 of the connecting part 5 of the backrest support 24 overlap in the forward-rearward direction, and the first bolt 61 is inserted through the first hole 55 and the third hole 483 and is fastened to a nut 63. Thereby, the backrest body 41 is connected to the backrest support 24. The nut 63 may be fixed to the inside of the connecting protrusion 48.

In this way, a recess 27 is formed between the backrest support 24 and the backrest body 41 connected to each other, which opens outward in the first diagonal direction, extends approximately in the up-down direction, and is surrounded by the protruding plate 26 of the backrest support 24, the connecting part outer side surface 54 of the connecting part 5, and the surface material-locking part 463 of the vertical frame 46 of the backrest body 41. The armrest body support 72 of the armrest 7 is inserted into the recess 27.

(Armrest)

Figure 12:
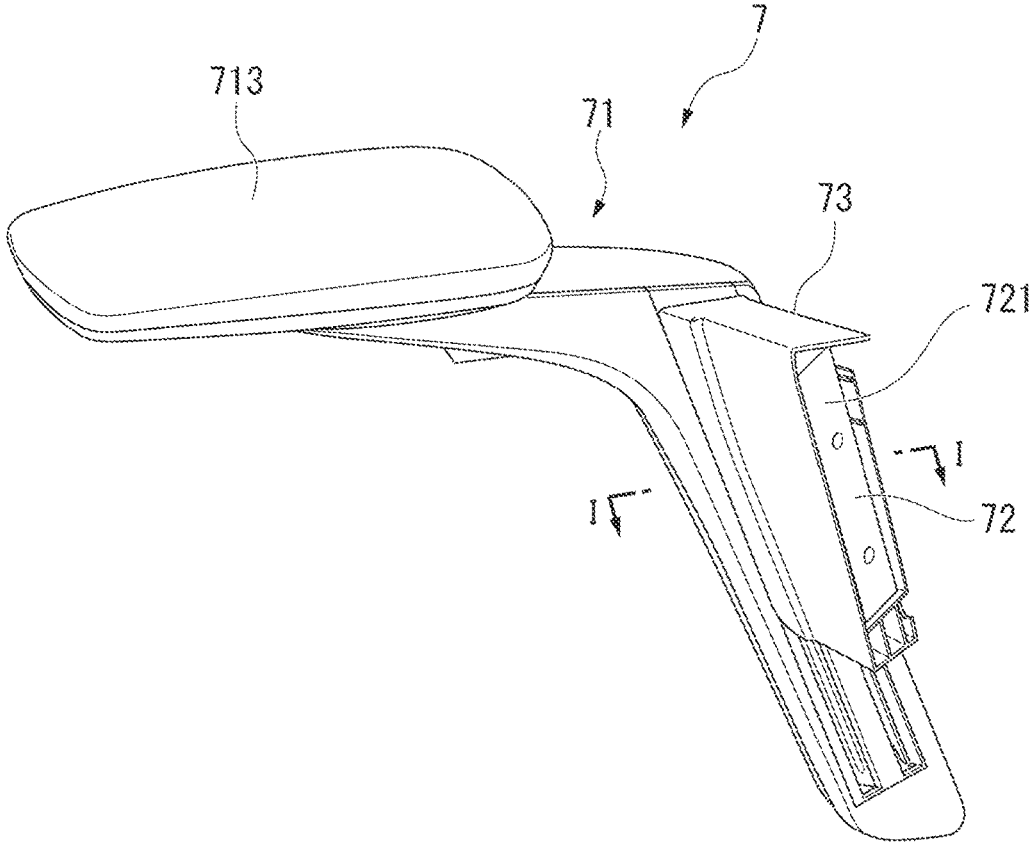
FIG. 12 is a perspective view of an armrest.
Figure 12:
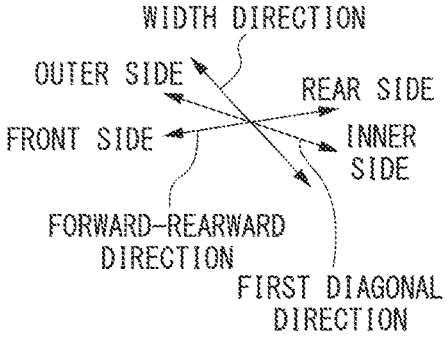
Figure 13:
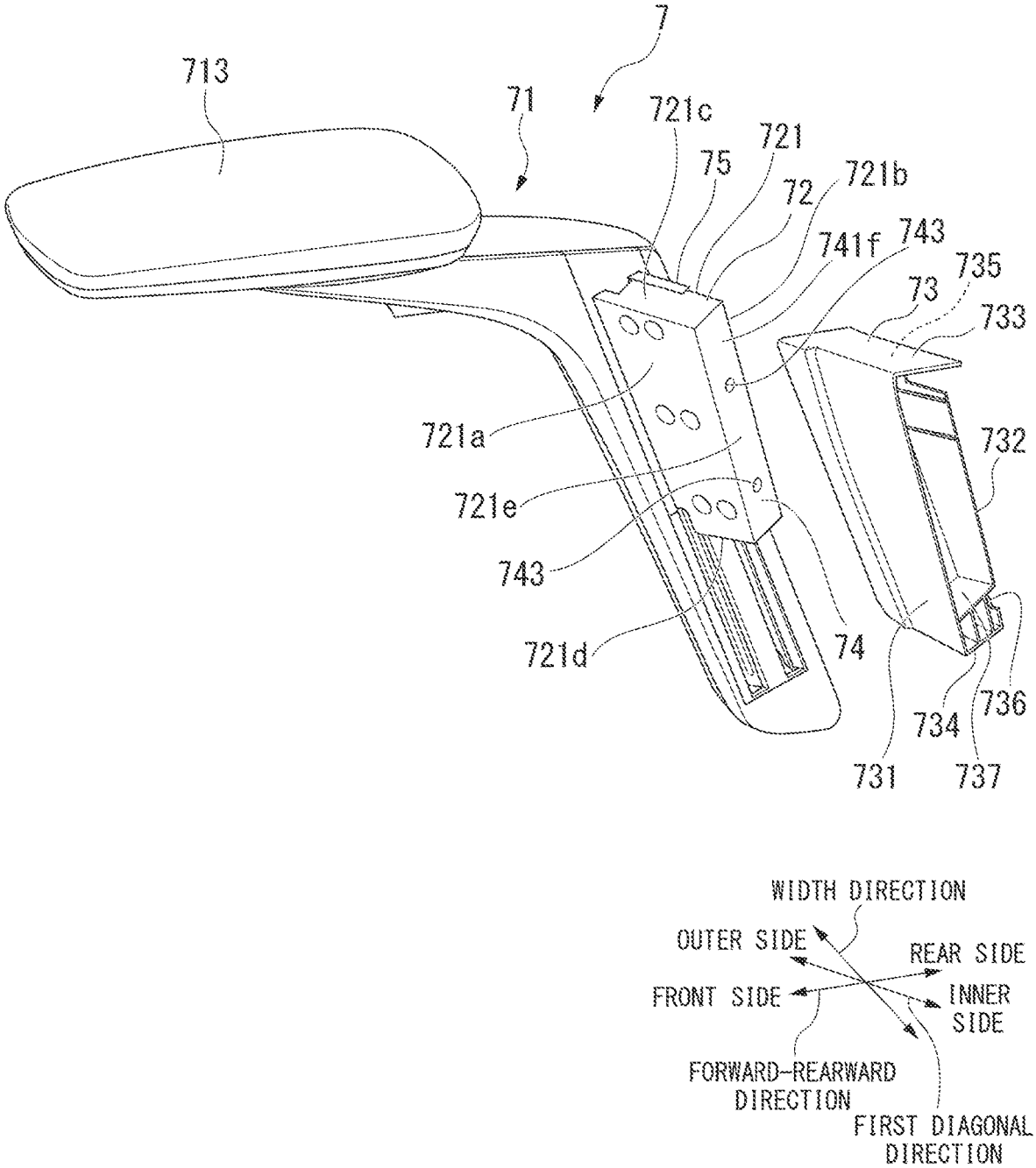
FIG. 13 is an exploded perspective view of the armrest.

As shown in FIGS. 12 and 13, the armrest 7 includes an armrest body 71 on which the seated person rests an elbow thereof, the armrest body support 72 fixed to the backrest support 24 and supporting the armrest body 71 such that the armrest body 71 can move up and down, and a cover member 73 covering the armrest body support 72.

Figure 14:
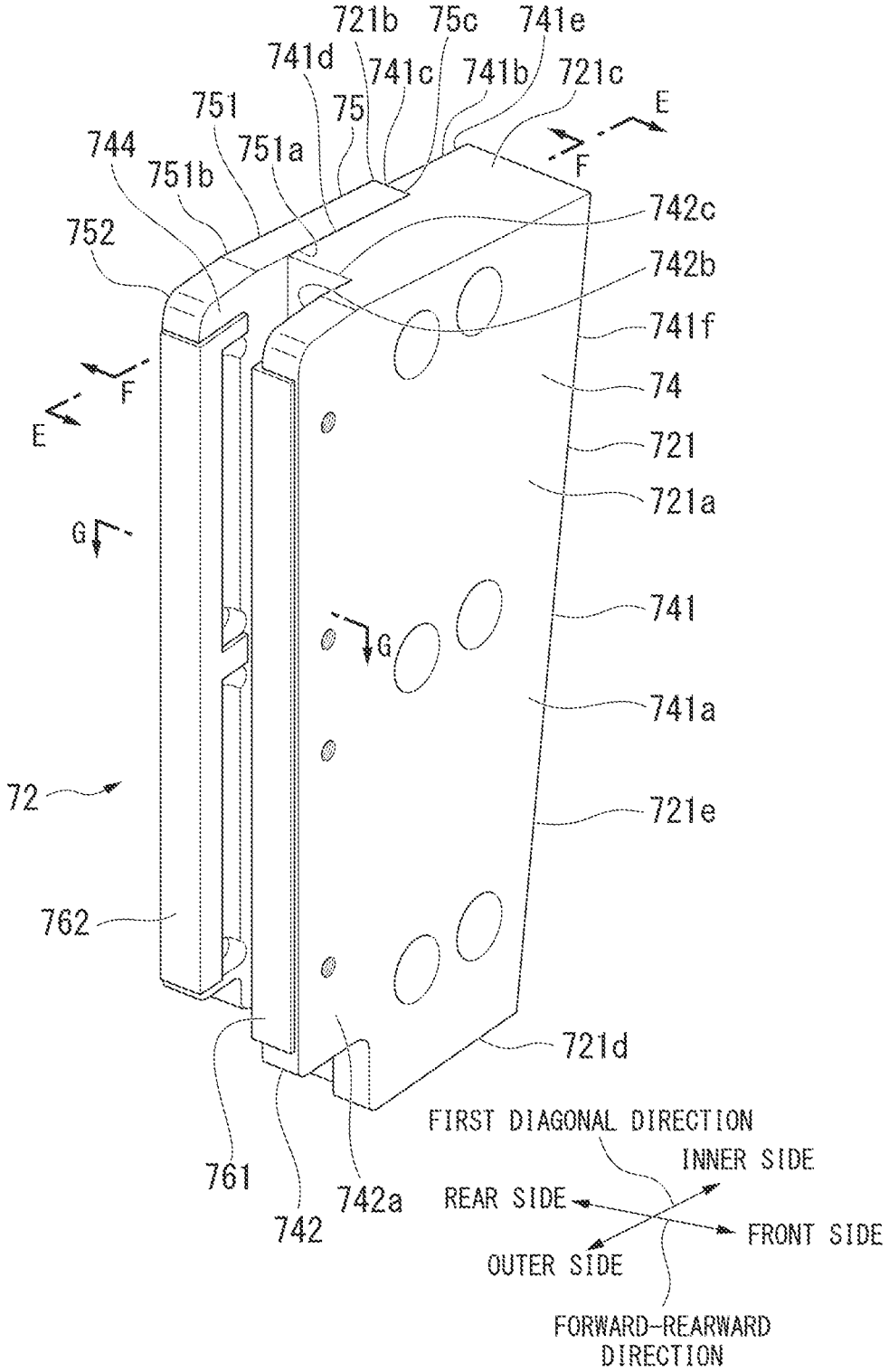
FIG. 14 is a perspective view of an armrest body support.

As shown in FIGS. 13 and 14, the armrest body support 72 includes a front member 74 that is an elongate block-shaped member and extends approximately in the up-down direction, and a rear member 75 that is an elongate block-shaped member and is connected to the rear side of the front member 74 in a posture of extending approximately in the up-down direction. The front member 74 and the rear member 75 are each formed of a metal such as an aluminum alloy and are connected through connectors (not shown) such as bolts.

The armrest body support 72 in which the front member 74 and the rear member 75 are connected has a shape extending in the first diagonal direction when viewed in the up-down direction.

The front member 74 includes a front connecting part 741 positioned inward in the first diagonal direction, and a front protruding piece 742 protruding outward in the first diagonal direction from a front side of the front connecting part 741.

A front-facing surface (referred to as a front surface 741*a*) of the front connecting part 741 and a front-facing surface (referred to as a front surface 742*a*) of the front protruding piece 742 are each formed into a surface facing forward in the forward-rearward direction and slightly inward in the width direction. The front surface 741*a* of the front connecting part 741 and the front surface 742*a* of the front protruding piece 742 are disposed to be flush with each other.

An intermediate part in the first diagonal direction of a rear-facing surface (referred to as a rear surface 741*b*) of the front connecting part 741 is provided with a first step part 741*c*, and an outer part 741*d* being further outward in the first diagonal direction than the first step part 741*c* is positioned further forward than an inner part 741*e* being further inward in the first diagonal direction than the first step part 741*c*. The outer part 741*d* and the inner part 741*e* of the rear surface 741*b* of the front connecting part 741 are both formed into surfaces facing rearward in the forward-rearward direction and slightly outward in the width direction.

A rear-facing surface (referred to as a rear surface 742*b*) of the front protruding piece 742 is formed into a surface facing rearward in the forward-rearward direction and slightly outward in the width direction. The rear surface 742*b* of the front protruding piece 742 is positioned further forward than the outer part 741*d* of the rear surface of the front connecting part 741. A second step part 742*c* is provided between the rear surface 742*b* of the front protruding piece 742 and the rear surface 741*b* of the front connecting part 741.

As shown in FIG. 13, a side surface (referred to as a first side surface 741*f*) on an inner side in the first diagonal direction of the front connecting part 741 is formed into a surface facing inward in the first diagonal direction.

Figure 15:
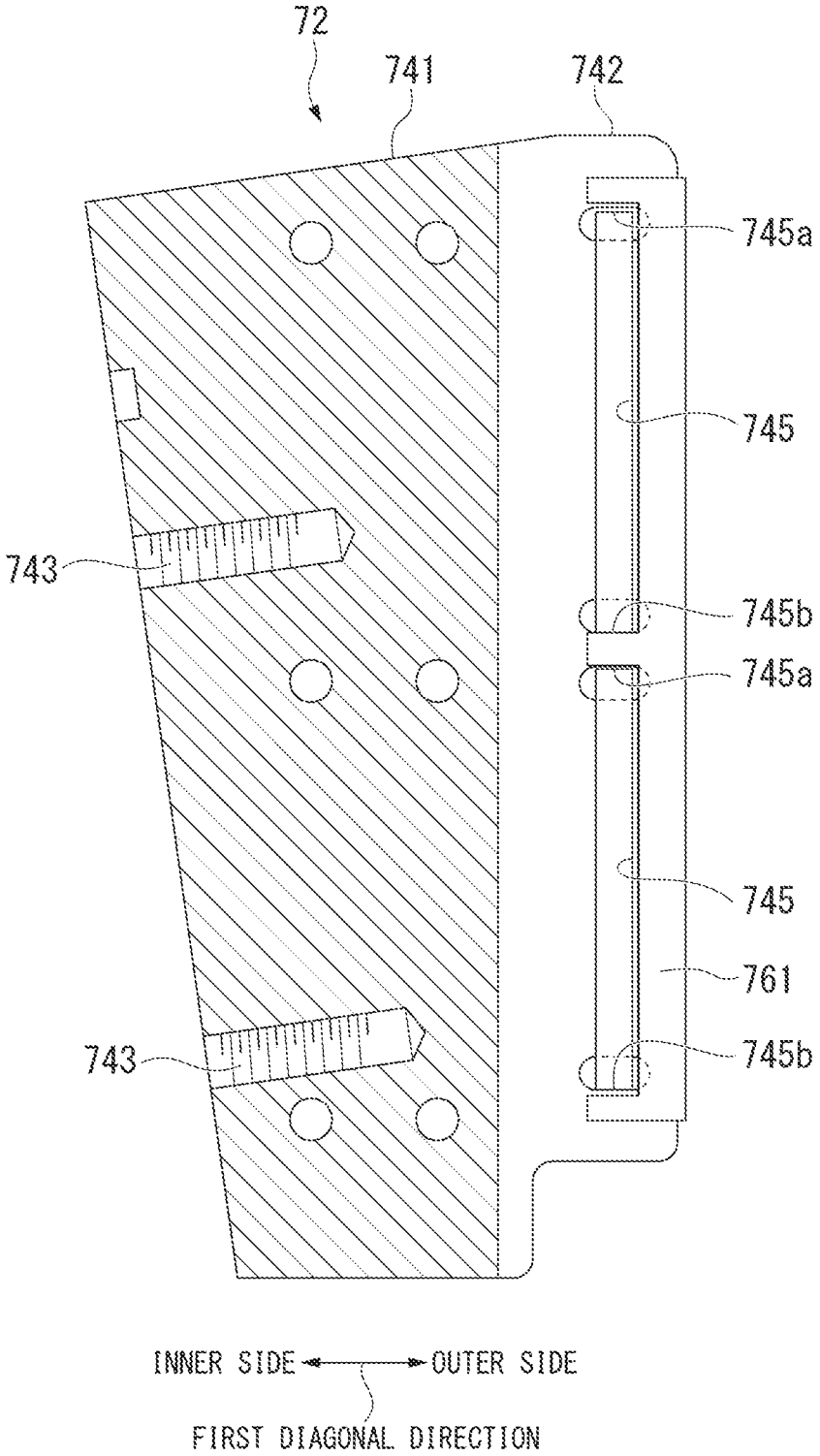
FIG. 15 is a cross-sectional view taken along line E-E in FIG. 14.
Figure 16:
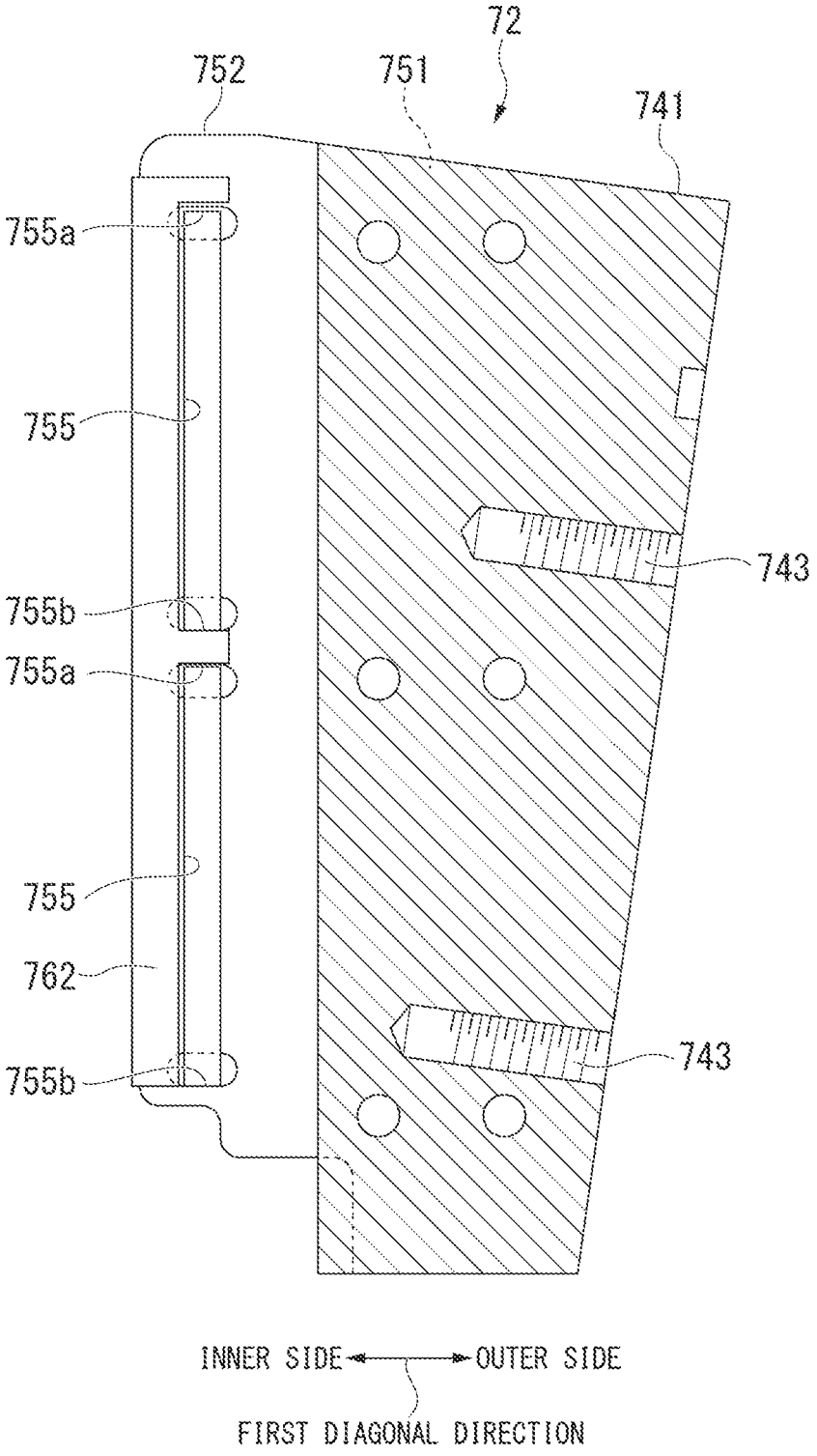
FIG. 16 is a cross-sectional view taken along line F-F in FIG. 14.
Figure 17:
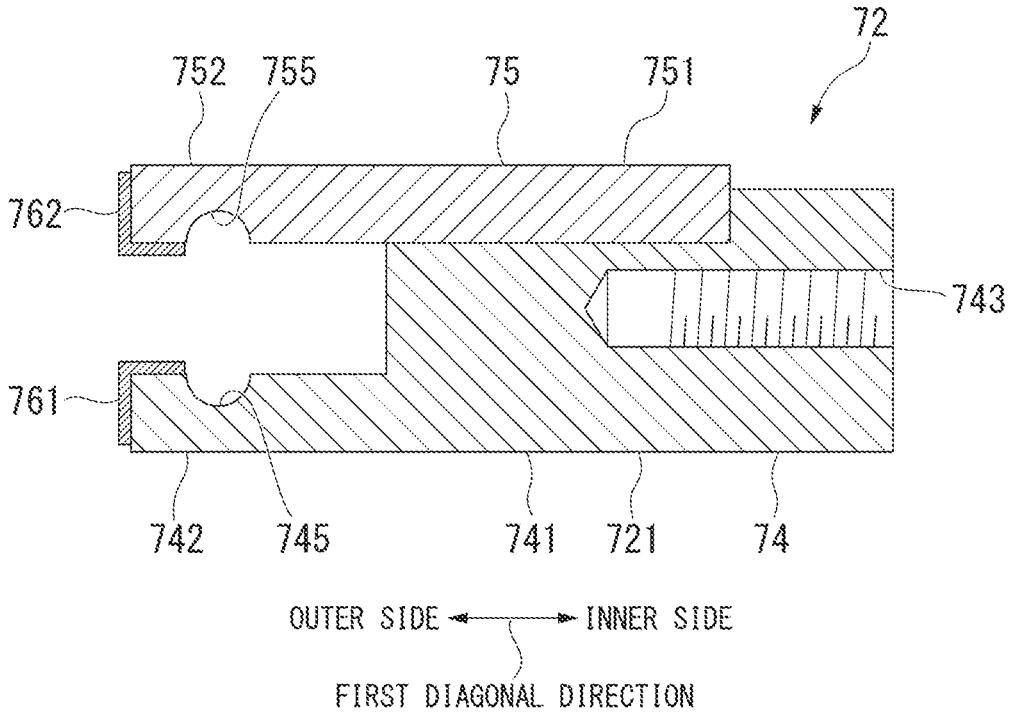
FIG. 17 is a cross-sectional view taken along line G-G in FIG. 14.

As shown in FIGS. 15 to 17, an inner part in the first diagonal direction of the front connecting part 741 is provided with recess-shaped fourth holes 743 opening inward in the first diagonal direction. The peripheral surface of the fourth hole 743 is provided with a screw thread. The fourth hole 743 is provided at each of two positions at an interval in the up-down direction.

As shown in FIG. 14, the rear member 75 is formed into a flat plate shape.

A front-facing surface (referred to as a front surface 75*a*) of the rear member 75 is formed into a surface facing forward in the forward-rearward direction and slightly inward in the width direction. A rear-facing surface (referred to as a rear surface 75*b*) of the rear member 75 is formed into a surface facing rearward in the forward-rearward direction and slightly outward in the width direction.

The rear member 75 is disposed such that an end 75*c* on an inner side in the first diagonal direction of the rear member 75 is positioned at the first step part 741*c* of the front member 74, and the rear member 75 protrudes further outward in the first diagonal direction than the front connecting part 741 of the front member 74.

The rear member 75 includes a rear connecting part 751 disposed behind and connected to the front connecting part 741, and a rear protruding piece 752 disposed outside in the first diagonal direction of the rear connecting part 751 and protruding further outward in the first diagonal direction than the front connecting part 741.

The front protruding piece 742 and the rear protruding piece 752 are disposed in parallel at an interval in the forward-rearward direction. Part of the armrest body support 72 being further outward in the first diagonal direction than the front connecting part 741 is provided with a lifting-lowering groove 744 disposed between the front protruding piece 742 and the rear protruding piece 752.

The front connecting part 741 of the front member 74 and the rear connecting part 751 of the rear member 75 connected to each other are referred to as a first base 721 as a whole. A front surface 721*a* of the first base 721 represents the front surface 741*a* of the front connecting part 741, a rear surface 721*b* of the first base 721 represents the inner part 741*e* of the rear surface 741*b* of the front connecting part 741 and the rear surface 751*b* of the rear connecting part 751, an upper surface 721*c* of the first base 721 represents the upper surfaces of the front connecting part 741 and the rear connecting part 751, and a lower surface 721*d* of the first base 721 represents the lower surfaces of the front connecting part 741 and the rear connecting part 751. A first side surface 721*e* on an inner side in the first diagonal direction of the first base 721 represents the first side surface 741*f* of the front connecting part 741.

As shown in FIG. 15, the rear surface 742*b* of the front protruding piece 742 is provided with two front protruding piece grooves 745 extending in the up-down direction at an interval in the up-down direction. The cross-section of the front protruding piece groove 745 is formed into a semicircular shape. The front protruding piece grooves 745 do not reach the upper end or the lower end of the front protruding piece 742 and are configured so as not to communicate with an area above or below the front protruding piece 742. A downward facing end surface positioned at the upper end of each of the two front protruding piece grooves 745 is referred to as a front protruding piece groove upper end surface 745*a*, and an upward facing end surface positioned at each lower end of the front protruding piece grooves 745 is referred to as a front protruding piece groove lower end surface 745*b*.

A first sliding material 761 is attached to an end surface on an outer side in the first diagonal direction and a rear surface of the front protruding piece 742. The first sliding material 761 is attached to a position not overlapping the front protruding piece grooves 745.

As shown in FIG. 16, a front surface 752*a* of the rear protruding piece 752 is provided with two rear protruding piece grooves 755 extending in the up-down direction at an interval in the up-down direction. The cross-section of the rear protruding piece groove 755 is formed into a semicircular shape. The rear protruding piece grooves 755 are disposed to be opposite to the front protruding piece grooves 745. The rear protruding piece grooves 755 do not reach the upper end or the lower end of the rear protruding piece 752 and are configured so as not to communicate with an area above or below the rear protruding piece 752. A downward facing end surface positioned at the upper end of each of the two rear protruding piece grooves 755 is referred to as a rear protruding piece groove upper end surface 755*a*, and an upward facing end surface positioned at each lower end of the rear protruding piece grooves 755 is referred to as a rear protruding piece groove lower end surface 755*b*.

A second sliding material 762 is attached to an end surface on an outer side in the first diagonal direction and a front surface of the rear protruding piece 752. The second sliding material 762 is attached to a position not overlapping the rear protruding piece grooves 755.

Figure 18:
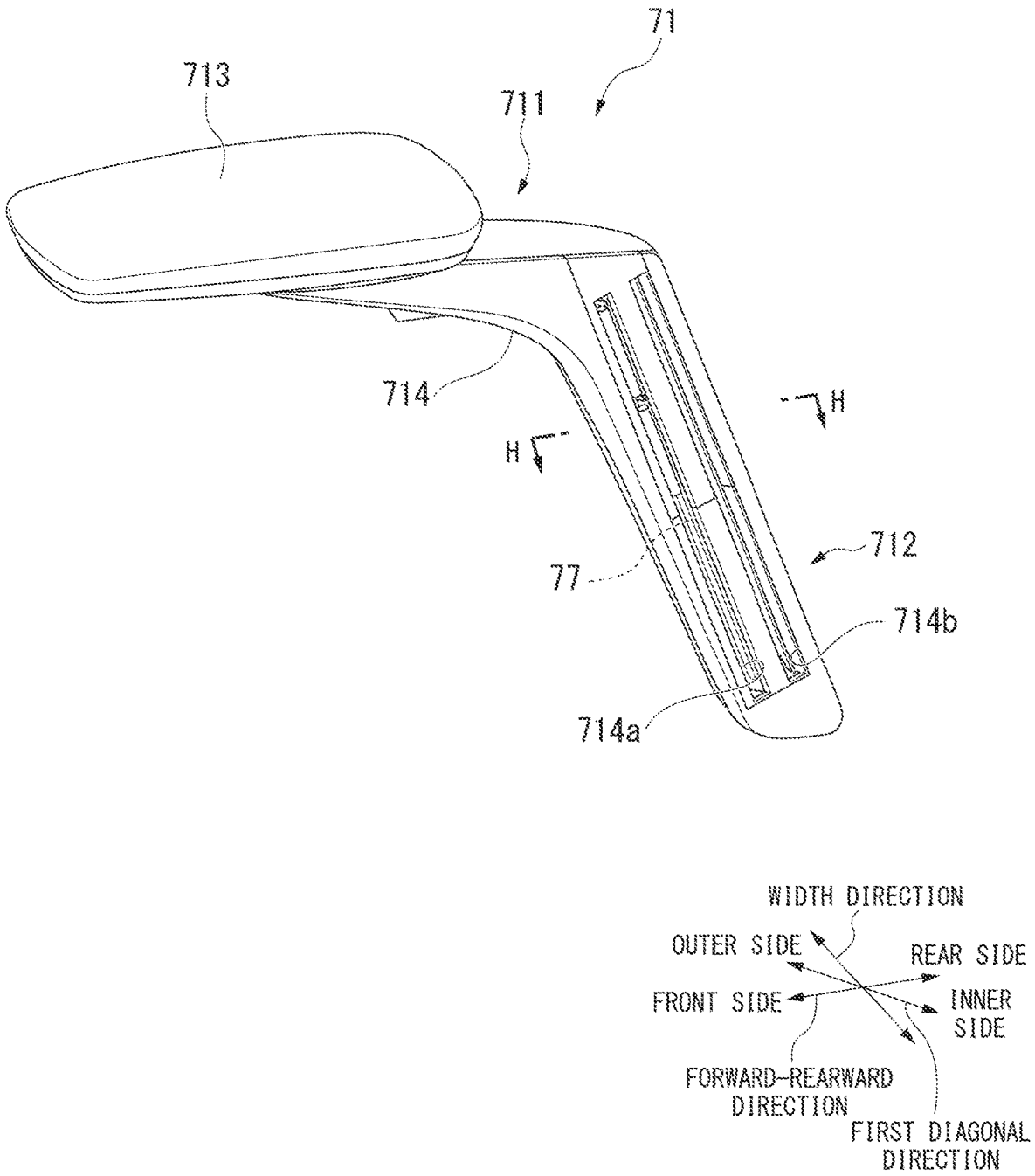
FIG. 18 is a perspective view of an armrest body.

As shown in FIG. 18, the armrest body 71 includes an upper rod 711 provided on an upper side thereof and extending in the forward-rearward direction, and a rear rod 712 provided on a rear side thereof and extending in a diagonal direction going downward and rearward from the rear end of the upper rod 711.

The top of a front part of the upper rod 711 is provided with an elbow rest 713.

The rear rod 712 is configured such that the armrest body support 72 (refer to FIG. 13) is attached to an inner side in the width direction of the rear rod 712. The rear rod 712 is formed to be longer in the up-down direction than the armrest body support 72.

The armrest body 71 includes an armrest body cover 714 serving as an outer shell, and part thereof covering the upper rod 711 and part thereof covering the rear rod 712 are integrally formed.

Figure 19:
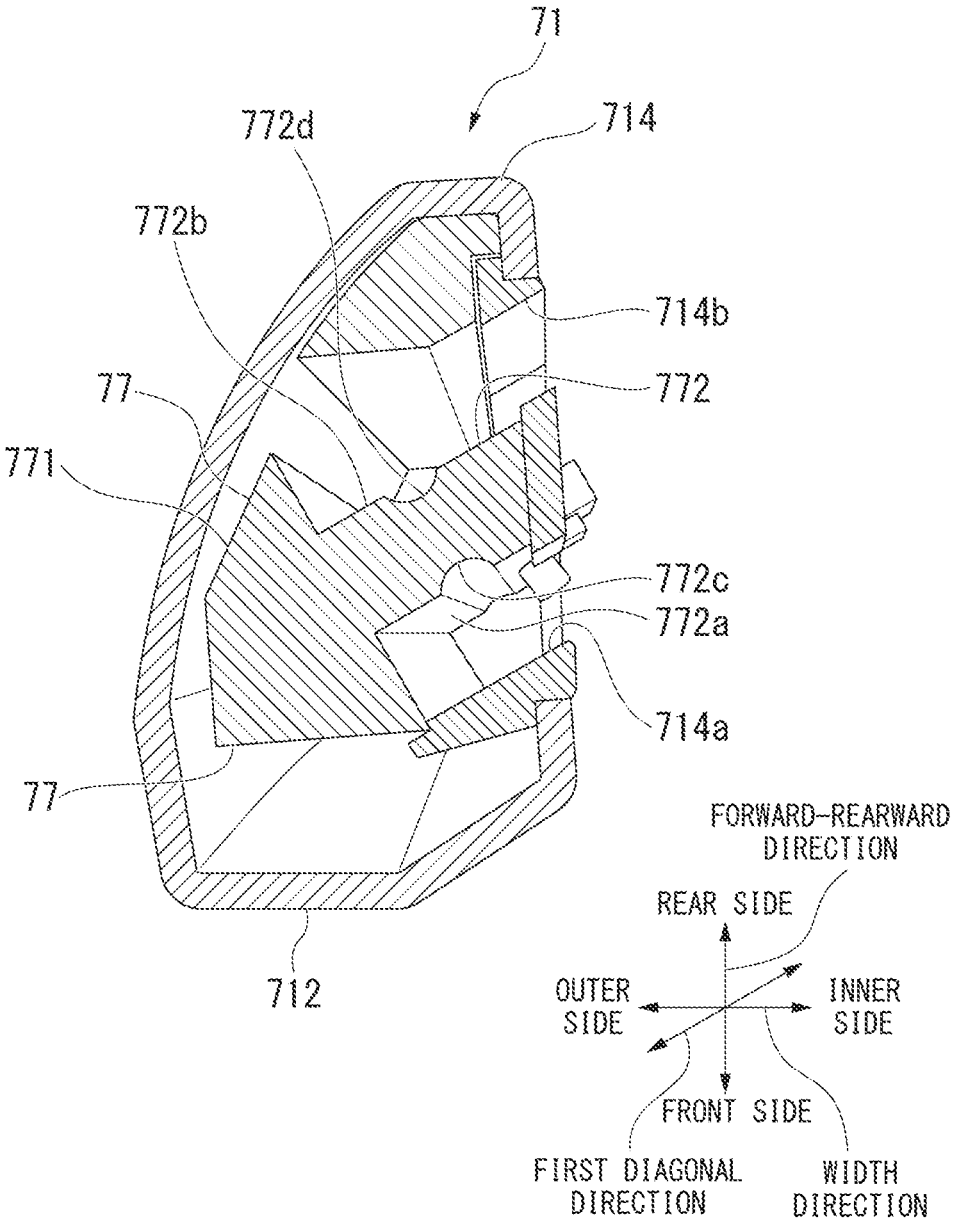
FIG. 19 is a cross-sectional view taken along line H-H in FIG. 18.

As shown in FIGS. 18 and 19, an inner side in the width direction of part of the armrest body cover 714, the part covering the rear rod 712, is provided with two armrest body cover grooves 714*a* and 714*b* extending in the up-down direction at an interval in the forward-rearward direction. The two armrest body cover grooves 714*a* and 714*b* are each formed to be longer than the size in the up-down direction of the armrest body support 72. Of the two armrest body cover grooves 714*a* and 714*b*, the front groove is referred to as a front armrest body cover groove 714*a* and the rear groove is referred to as a rear armrest body cover groove 714*b*.

Figure 20:
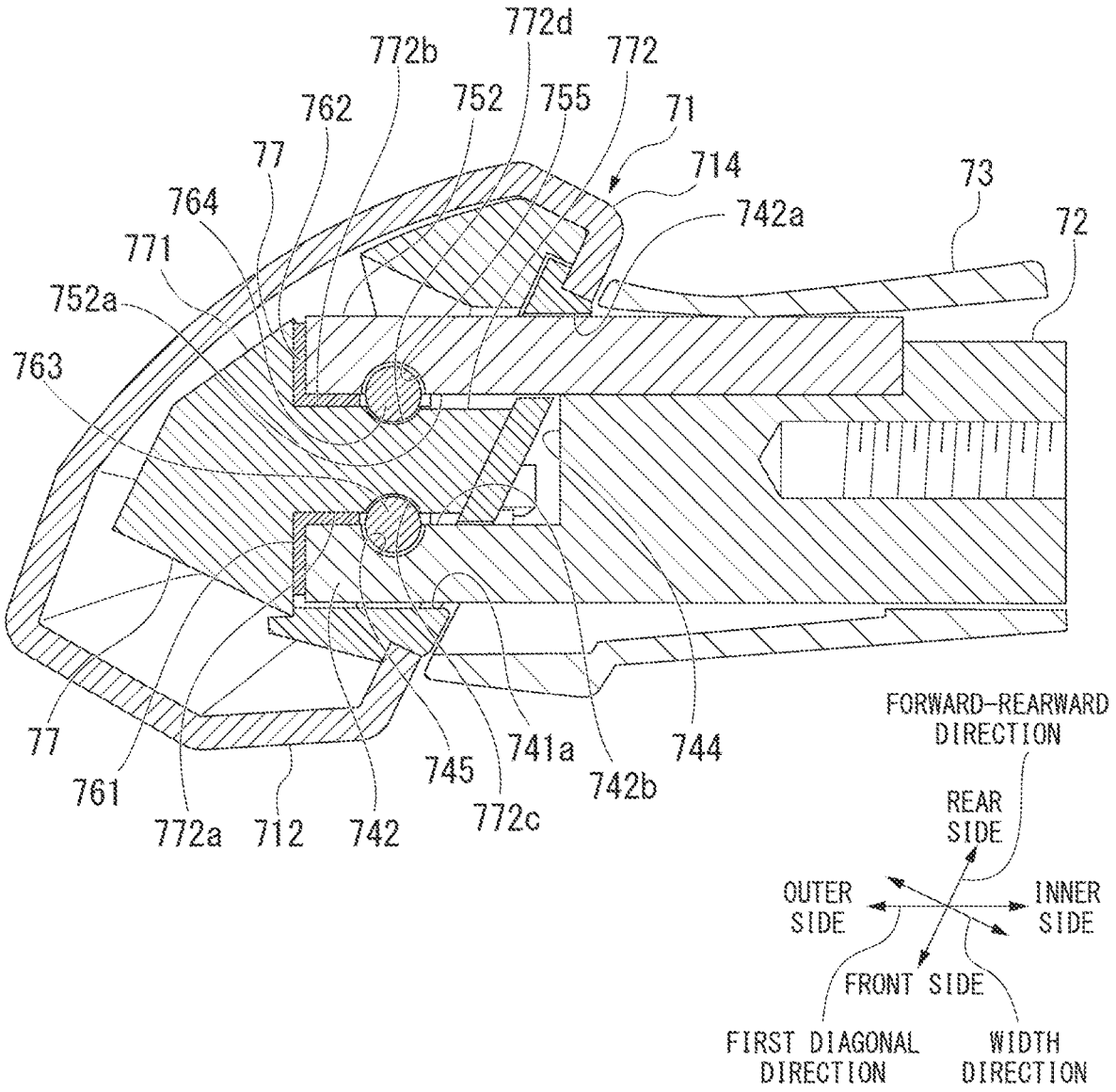
FIG. 20 is a cross-sectional view taken along line I-I in FIG. 12.

As shown in FIG. 20, the front protruding piece 742 of the armrest body support 72 is configured to be inserted into the armrest body cover 714 of the rear rod 712 through the front armrest body cover groove 714*a*, and the rear protruding piece 752 of the armrest body support 72 is configured to be inserted into the armrest body cover 714 of the rear rod 712 through the rear armrest body cover groove 714*b*.

In this embodiment, part of the armrest body cover 714 provided with the two armrest body cover grooves 714*a* and 714*b* is formed as a member detachable from the other part.

As shown in FIGS. 19 and 20, the inside of the armrest body cover 714 of the rear rod 712 is provided with a rail member 77, and the rail member 77 engages with the armrest body support 72 so as to movable relative thereto in the up-down direction. The rail member 77 is formed so as to have a size in the up-down direction slightly less than the size in the up-down direction of the rear rod 712 and greater than the size in the up-down direction of the armrest body support 72.

Figure 21:
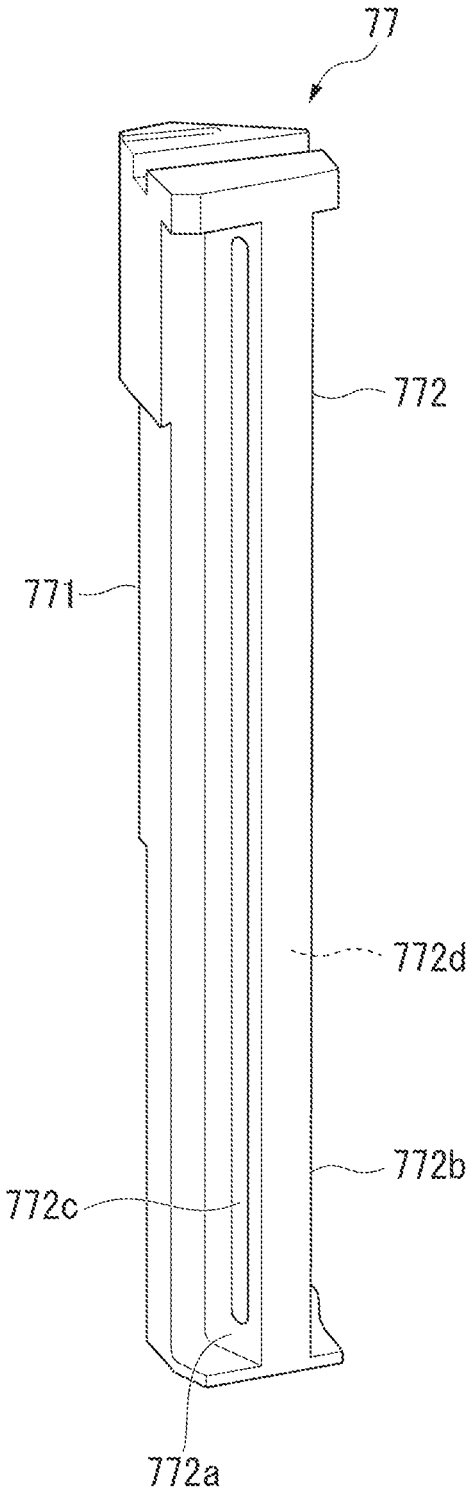
FIG. 21 is a perspective view of a rail member.

As shown in FIGS. 19 to 21, the rail member 77 includes a rod-shaped second base 771 extending in the up-down direction and a protruding ridge 772 protruding inward in the first diagonal direction from the entire range in the up-down direction of the second base 771. The protruding ridge 772 protrudes inward in the first diagonal direction from an intermediate part in the forward-rearward direction of the second base 771.

A front-facing surface (referred to as a front surface 772*a*) of the protruding ridge 772 is formed into a surface facing forward in the forward-rearward direction and slightly inward in the width direction. A rear-facing surface (referred to as a rear surface 772*b*) of the protruding ridge 772 is formed into a surface facing rearward in the forward-rearward direction and slightly outward in the width direction. The front surface 772*a* and the rear surface 772*b* of the protruding ridge 772 are parallel to each other.

The front surface 772*a* of the protruding ridge 772 is provided with a protruding ridge front groove 772*c* extending on the entire front surface 772*a* in the up-down direction. The cross-section of the protruding ridge front groove 772*c* is formed into an arc shape.

The rear surface 772*b* of the protruding ridge 772 is provided with a protruding ridge rear groove 772*d* extending on the entire rear surface 772*b* in the up-down direction. The cross-section of the protruding ridge rear groove 772*d* is formed into an arc shape.

The rail member 77 is disposed inside the armrest body cover 714 at a position overlapping the two armrest body cover grooves 714*a* and 714*b*. As shown in FIG. 20, the protruding ridge 772 of the rail member 77 is inserted into the lifting-lowering groove 744 between the front protruding piece 742 and the rear protruding piece 752 of the armrest body support 72 inserted into the armrest body cover 714 of the rear rod 712 through the armrest body cover grooves 714*a* and 714*b*. The second base 771 of the rail member 77 contacts the end surfaces of the front protruding piece 742 and the rear protruding piece 752 through the sliding materials 761 and 762.

The front surface 772*a* of the protruding ridge 772 faces the rear surface 742*b* of the front protruding piece 742 with a gap interposed therebetween. The protruding ridge front groove 772*c* of the front surface 772*a* of the protruding ridge 772 faces both of the two front protruding piece grooves 745 of the rear surface 742*b* of the front protruding piece 742.

A columnar front retainer 763 extending in the up-down direction is provided between the protruding ridge front groove 772*c* and each of the two front protruding piece grooves 745. The surface of the front retainer 763 is formed so as to have a sliding surface.

The front retainer 763 is formed so as to have a length slightly less than the size in the length direction of the front protruding piece groove 745, and the front halves of the front retainers 763 are inserted into the two front protruding piece grooves 745. The front retainer 763 inserted into the front protruding piece groove 745 is limited from moving in the up-down direction relative to the front protruding piece 742 by the front protruding piece groove upper end surface 745*a* and the front protruding piece groove lower end surface 745*b* of the front protruding piece groove 745.

The rear half of the front retainer 763 is inserted into the protruding ridge front groove 772*c* of the protruding ridge 772. The front retainer 763 inserted into the protruding ridge front groove 772*c* is configured to be movable relative to the protruding ridge 772 along the protruding ridge front groove 772*c* in the up-down direction.

The rear surface 772*b* of the protruding ridge 772 faces the front surface 752*a* of the rear protruding piece 752 with a gap interposed therebetween. The protruding ridge rear groove 772*d* of the rear surface 772*b* of the protruding ridge 772 faces both of the two rear protruding piece grooves 755 of the front surface 752*a* of the rear protruding piece 752.

A columnar rear retainer 764 extending in the up-down direction is provided between the protruding ridge rear groove 772*d* and each of the two rear protruding piece grooves 755. The surface of the rear retainer 764 is formed so as to have a sliding surface.

A columnar rear retainer 764 extending in the up-down direction is provided between the protruding ridge front groove 772*c* and each of the two rear protruding piece grooves 755. The surface of the rear retainer 764 is formed so as to have a sliding surface.

The rear retainer 764 is formed so as to have a length slightly less than the size in the length direction of the rear protruding piece groove 755, and the front halves of the rear retainers 764 are inserted into the two rear protruding piece grooves 755. The rear retainer 764 inserted into the rear protruding piece groove 755 is limited from moving in the up-down direction relative to the rear protruding piece 752 by the rear protruding piece groove upper end surface 755*a* and the rear protruding piece groove lower end surface 755*b* of the rear protruding piece groove 755.

The rear half of the rear retainer 764 is inserted into the protruding ridge rear groove 772*d* of the protruding ridge 772. The rear retainer 764 inserted into the protruding ridge rear groove 772*d* is configured to be movable relative to the protruding ridge 772 along the protruding ridge rear groove 772*d* in the up-down direction.

The armrest body 71 is configured to be movable up and down in the up-down direction with respect to the armrest body support 72 in a state where the protruding ridge 772 of the rail member 77 is inserted into the lifting-lowering groove 744 of the armrest body support 72. The front retainer is provided between the protruding ridge 772 of the rail member 77 and the front protruding piece 742 of the armrest body support 72, the rear retainer is provided between the protruding ridge 772 of the rail member 77 and the rear protruding piece 752 of the armrest body support 72, and thereby the armrest body support 72 is prevented from separating from the rail member 77 or coming out of the armrest body 71.

Although it is not shown, a height adjuster is provided, which includes a known structure that holds the armrest body 71 to a desired height.

As shown in FIGS. 12 and 13, the cover member 73 covers the first base 721 of the armrest body support 72. The cover member 73 is formed into a cylindrical shape and is disposed so as to open in the first diagonal direction. The cover member 73 includes a front plate 731 covering the front surface 721*a* of the first base 721, a rear plate 732 covering the rear surface 721*b* of the first base 721, an upper plate 733 covering the upper surface 721*c* of the first base 721, and a lower plate 734 covering the lower surface 721*d* of the first base 721.

The front plate 731 has the upper end positioned above the upper surface 721*c* of the first base 721, and the lower end positioned below the lower surface 721*d* of the first base 721. The end on an inner side in the first diagonal direction of the front plate 731 is disposed at a position overlapping the first side surface 721*e* of the first base 721.

The edge on an outer side in the first diagonal direction of the front plate 731 is disposed at a position overlapping the edge on an outer side in the first diagonal direction of the first base 721.

An intermediate part in the first diagonal direction of a front surface 731*a* of the front plate 731 is provided with a front plate step part 731*b* extending in the up-down direction. In the front plate 731, an outer part 731*c* being further outward in the first diagonal direction than the front plate step part 731*b* is positioned to be further forward than an inner part 731*d* being further inward in the first diagonal direction than the front plate step part 731*b*.

The rear plate 732 has the upper end positioned above the upper surface 721*c* of the first base 721, and the lower end positioned below the lower surface 721*d* of the first base 721. The end on an inner side in the first diagonal direction of the front plate 731 is disposed at a position overlapping the first side surface 721*e* of the first base 721.

The edge on an outer side in the first diagonal direction of the front plate 731 is disposed at a position overlapping the edge on an outer side in the first diagonal direction of the first base 721.

The upper plate 733 has the front edge connected to the upper edge of the front plate 731, and the rear edge connected to the upper edge of the rear plate 732. The edge on an outer side in the first diagonal direction of the upper plate 733 is disposed at a position overlapping the vicinity of the edge on an outer side in the first diagonal direction of the first base 721. The upper plate 733 protrudes further inward in the width direction than the front plate 731 and the rear plate 732. Part of the upper plate 733 further protruding inward in the width direction than the front plate 731 and the rear plate 732 is referred to as a protruding plate 733*b*. The protruding plate 733*b* further protrudes inward in the width direction than the first base 721.

The lower side of the upper plate 733 is provided with a plurality of upper ribs 735 protruding downward from the lower surface of the upper plate 733. The upper rib 735 is configured such that the lower end thereof contacts the upper surface 721*c* of the first base 721.

The lower plate 734 has the front edge connected to the lower edge of the front plate 731 and the rear edge connected to the lower edge of the rear plate 732. The edge on an outer side in the width direction of the lower plate 734 is disposed at a position overlapping the vicinity of the edge on an outer side in the width direction of the first base 721. The edge on an inner side in the width direction of the lower plate 734 is disposed at a position overlapping the lower side of the first side surface 721*e* of the first base 721.

The upper side of the lower plate 734 is provided with a plurality of lower ribs 736 protruding upward from the upper surface of the lower plate 734 and an inner plate 737 provided above the lower ribs 736. The inner plate 737 has the plate surface facing approximately in the up-down direction, the front edge connected to the front plate 731, and the rear edge connected to the rear plate 732. The upper surface of the inner plate 737 is configured to contact the lower surface 721*d* of the first base 721.

In the armrest 7, the armrest body support 72 is fixed to the backrest support 24 in a state where the armrest body support 72 and the armrest body 71 are connected and the cover member 73 is attached to the first base 721 of the armrest body support 72. The following shows a state where the armrest body support 72 and the armrest body 71 are connected and the cover member 73 is attached to the first base 721 of the armrest body support 72.

The armrest 7 is fixed to the backrest support 24 such that the armrest body support 72 and the cover member 73 are inserted into the recess 27 between the backrest support 24 and the backrest body 41 connected to each other after the backrest body 41 is fixed to the backrest support 24. As described above, the recess 27 is surrounded by the protruding plate 26 of the backrest support 24, the connecting part outer side surface 54 of the connecting part 5, and the surface material-locking parts 463 of the vertical frames 46 of the backrest body 41 and opens outward in the first diagonal direction.

As shown in FIGS. 8 and 9, when fixing the armrest 7 to the backrest support 24, first, part on an inner side in the first diagonal direction of the armrest body support 72 is inserted into the recess 27.

At this time, the armrest 7 is inserted into the recess 27 such that the upper and lower two fourth holes 743 of the armrest body support 72 overlap the upper and lower two second holes 56 of the connecting part 5 in the first diagonal direction.

Then, the first side surface 721*e* of the first base 721 is brought into contact with the connecting part outer side surface 54 of the connecting part 5 of the backrest support 24, and the edges on inner sides in the first diagonal direction of the front plate 731, the rear plate 732 and the lower plate 734 (refer to FIG. 13) of the cover member 73 are brought into contact with the connecting part outer side surface 54. The protruding plate 733*b* of the upper plate 733 of the cover member 73 is disposed above the connecting part 5, and the lower surface of the protruding plate 733*b* and the upper surface of the connecting part 5 are brought into contact with each other. The inner part 731*d* of the front surface 731*a* of the front plate 731 of the cover member 73 is brought into contact with the rear surface of the surface material-locking part 463 of the vertical frame 46 of the backrest body 41.

The connecting part 5 and the armrest body support 72 are positioned behind the surface material 43, and the second hole 56 of the connecting part 5 and the fourth hole 743 of the armrest body support 72 open in a diagonal direction going outward in the width direction and forward. The opening directions of the second hole 56 and the fourth hole 743 are along the backrest body 41. The opening directions of the second hole 56 and the fourth hole 743 are parallel with a direction approaching the backrest surface 431 and going outward from the inside in the width direction.

The second bolt 62 is inserted into the second hole 56 and the fourth hole 743 outward from the inside in the width direction. Therefore, the second bolt 62 is configured to be inserted through the second hole 56 and the fourth hole 743 from the side away from the backrest surface 431 to the side closer to the backrest surface 431.

The second bolt 62 is inserted into the second hole 56 and the fourth hole 743 from the inside in the width direction and is fastened to the nut, and thus the armrest body support 72 is fixed to the backrest support 24.

At this time, the connecting part front surface 51 and the inner part 731*d* of the front surface 731*a* of the front plate 731 of the cover member 73 are disposed to be approximately flush with each other.

The armrest body support 72 and the cover member 73 are sandwiched between the surface material-locking part 463 of the vertical frame 46 and the protruding plate 26 of the backrest support 24 from the front and behind, and the connection point between the connecting port 5 and both of the armrest body support 72 and the cover member 73 is covered thereby. The end on an outer side in the width direction of the surface material-locking part 463 of the vertical frame 46 is disposed along the front plate step part 731*b* of the front plate 731 of the cover member 73 and contacts the front plate step part 731*b* from the inside in the width direction. Therefore, it is prevented that the cover member 73 and the vertical frame 46 are shifted from each other in the width direction.

As shown in FIG. 2, the armrest body support 72 and the cover member 73 protrude outward in the width direction from the backrest body 41, and the armrest body 71 supported by the armrest body support is separated from the backrest body 41 and is positioned further outward in the width direction than the outer peripheral frame 42. The upper rod 711 of the armrest body 71 extends in the forward-rearward direction. The elbow rest 713 of the upper rod 711 of the armrest body 71 is disposed further forward than the backrest body 41 and thus is separated from the backrest body 41.

After the armrest 7 is fixed to the backrest support 24, the backrest body 41 may be fixed to the backrest support 24.

Next, the functions and effects of the backrest and the chair of this embodiment described above are described with reference to the drawings.

In the backrest 4 and the chair 1 of this embodiment described above, the armrest body 71 is supported by the backrest support 24 so as to move up and down at a position separated from the backrest body 41, whereby the armrest body 71 can be prevented from contacting the backrest body 41 at the time the armrest body 71 is moved up and down.

Since the armrest body support 72, which is supported by the backrest support 24 and supports the armrest body 71 such that the armrest body 71 is movable up and down, is provided, the lifting and lowering mechanism for lifting and lowering the armrest body 71 can be provided in the armrest body support 72 without being provided in the backrest support 24, and thus the backrest support 24 can have a simpler structure than a case where the backrest support 24 is provided with the lifting and lowering mechanism.

Since the backrest support 24 includes the connecting part 5 to which the armrest body support 72 is connected in a state where the armrest body support 72 contacts the connecting part 5 from the outside in the width direction, the armrest body support 72 can be firmly connected to the backrest support 24.

The armrest body support 72 is provided behind the backrest body 41, the backrest body 41 includes the protruding plate 26 integrally provided on the front sides of the connecting part 5 and the armrest body support 72, thereby the connection point between the connecting part 5 and the armrest body support 72 is not exposed forward by the protruding plate 26, and thus the design level of the backrest 4 can be improved.

The backrest support 24 includes the rear shielding wall protruding outward in the width direction from the rear edge 57 of the connecting part 5, thereby the connection point between the connecting part 5 and the armrest body support 72 is not exposed rearward by the rear shielding wall, and thus the design level of the backrest 4 can be improved.

The backrest body 41 includes the outer peripheral frame 42 and the surface material 43 that is stretched on the outer peripheral frame 42 and covers the outer edge of the outer peripheral frame 42, thereby even if the surface material 43 of the backrest body 41 covers the outer edge of the outer peripheral frame 42, the armrest body 71 can be prevented from contacting the surface material 43 of the backrest body 41 when the armrest body 71 is moved up and down.

Hereinbefore, the embodiment of the backrest and the chair of the present invention has been described, but the present invention is not limited to the above-described embodiment, and modifications may be adopted within the scope of the present invention.

For example, in the above embodiment, the armrest body support 72, which is supported by the backrest support 24 and supports the armrest body 71 such that the armrest body 71 is movable up and down, is provided, but the armrest body 71 may be directly supported by the backrest support 24.

In the above embodiment, the backrest support 24 is provided with the connecting part 5 to which the armrest body support 72 is connected in contact from the outside in the width direction, but the connecting part 5 may not be provided.

In the above embodiment, the armrest body support 72 is provided behind the backrest body 41 and the backrest body 41 includes the protruding plate 26 integrally provided on the front sides of the connecting part 5 and the armrest body support 72, but the protruding plate 26 may not be provided.

In the above embodiment, the backrest support 24 is provided with the surface material-locking part 463 protruding outward in the width direction from the rear edge 57 of the connecting part 5, but the surface material-locking part 463 may not be provided.

In the above embodiment, the backrest body 41 includes the outer peripheral frame 42 and the surface material 43 that is stretched on the outer peripheral frame 42 and covers the outer edge of the outer peripheral frame 42, but the backrest body may have a shape other than the above.

INDUSTRIAL APPLICABILITY

By applying a backrest and a chair of the present invention to this field, it is possible to provide a backrest and a chair that can prevent contact between an armrest (armrest body) that moves up and down and a backrest body.

What is claimed is:

1. A backrest, comprising:

a backrest body against which a seated person leans a back thereof;

a backrest support positioned rear side of the backrest body and supporting the backrest body;

an armrest body provided at a position outside the width of the backrest body in a width direction and supported by the backrest support so as to move up and down at a position separated from the backrest body; and an armrest body support attached to the backrest support, the armrest body being attached to the armrest body support so as to move up and down, wherein the backrest support includes a connecting part to which the armrest body support is connected in a state where the armrest body support contacts the connecting part from a position outside the width of the backrest support in the width direction, the armrest body support is provided at a rear side of the backrest body, and the backrest body includes a front shielding wall, the front shielding wall shielding a connection point between the connecting part and the armrest body support, the front shielding wall provided in front of the connection point.

2. The backrest according to claim 1, wherein the backrest body includes an outer peripheral frame, and a surface material stretched on the outer peripheral frame and covering at least part of an outer edge of the outer peripheral frame.

3. A chair comprising the backrest according to claim 1.

4. A backrest, comprising:

a backrest body against which a seated person leans a back thereof;

a backrest support positioned rear side of the backrest body and supporting the backrest body;

an armrest body provided at a position outside the width of the backrest body in a width direction and supported by the backrest support so as to move up and down at a position separated from the backrest body; and an armrest body support attached to the backrest support, the armrest body being attached to the armrest body support so as to move up and down, wherein the backrest support includes a connecting part to which the armrest body support is connected in a state where the armrest body support contacts the connecting part from a position outside the width of the backrest support in the width direction, the backrest support includes a rear shielding wall, the rear shielding wall protruding outward in the width direction from a rear edge of the connecting part, the rear shielding wall shielding a connection point between the connecting part and the armrest body support, the rear shielding wall provided rear side of the connection point.

5. The backrest according to claim 4, wherein the backrest body includes an outer peripheral frame, and a surface material stretched on the outer peripheral frame and covering at least part of an outer edge of the outer peripheral frame.

6. A chair comprising the backrest according to claim 4.

* * * * *